US007693650B2

(12) United States Patent
Kumagai et al.

(10) Patent No.: US 7,693,650 B2
(45) Date of Patent: Apr. 6, 2010

(54) SYSTEM AND METHOD FOR COLLECTING AND DISTRIBUTING TRAFFIC INFORMATION

(75) Inventors: Masatoshi Kumagai, Ibaraki (JP); Tomoaki Hiruta, Ibaraki (JP); Mariko Okude, Ibaraki (JP); Koichiro Tanikoshi, Ibaraki (JP)

(73) Assignee: Xanavi Informatics Corporation, Zama-shi (JP)

( * ) Notice: Subject to any disclaimer, the term of this patent is extended or adjusted under 35 U.S.C. 154(b) by 382 days.

(21) Appl. No.: 11/848,343

(22) Filed: Aug. 31, 2007

(65) Prior Publication Data

US 2008/0059051 A1 Mar. 6, 2008

(30) Foreign Application Priority Data

Sep. 5, 2006 (JP) ..... 2006-240017

(51) Int. Cl.
*G08G 1/00* (2006.01)

(52) U.S. Cl. ..... 701/117

(58) Field of Classification Search ..... 701/117–119, 701/201–202, 210, 213; 340/995.13, 995.19
See application file for complete search history.

(56) References Cited

U.S. PATENT DOCUMENTS

2003/0125874 A1 * 7/2003 Fushiki et al. ..... 701/211

FOREIGN PATENT DOCUMENTS

| | | | |
|---|---|---|---|
| DE | 196 51 143 | A1 | 6/1998 |
| EP | 0 921 509 | A2 | 6/1999 |
| JP | 2003-296891 | A | 10/2003 |

OTHER PUBLICATIONS

European Search Report dated Sep. 17, 2008 (Seven (7) pages).

* cited by examiner

*Primary Examiner*—Kim T Nguyen
(74) *Attorney, Agent, or Firm*—Crowell & Moring LLP

(57) ABSTRACT

In a center apparatus, a feature space projection processing unit performs a feature space projection process for probe data corresponding to a road section which are stored in a current probe data storage unit to extract the feature data, and a change point detecting unit; an event section partitioning unit and an event assigning unit determine a road section corresponding to the feature data, and assign the event information to the determined road section; and an event information distributing unit distributes the event information assigned to the road section. In a vehicle-installed terminal apparatus, a probe data partitioning unit and an orthogonal component decomposition unit performs processes of partitioning and orthogonal component decomposition of the probe data using a feature score vector obtained from the center apparatus, to thereby reduce the probe data to be uplinked.

8 Claims, 15 Drawing Sheets

FIG.2

(Probe data)

| |
|---|
| Date/time information |
| Section information |
| Sensor #1 name |
| Sensor #1 name |
| Sensor #1 data $d_{11}$<br>data $d_{12}$<br>⋮<br>data $d_{1n}$ |
| Sensor #2 name |
| Sensor #2 data $d_{21}$<br>data $d_{22}$<br>⋮<br>data $d_{2n}$ |
| ⋮ |
| Sensor #s name |
| Sensor #s data $d_{S1}$<br>data $d_{S2}$<br>⋮<br>data $d_{S3}$ |

(Event data)

| |
|---|
| Date/time information |
| Section information |
| Event label |

1301 Normal acceleration history

| Trip \ Position | 0m | 10m | 20m | ... |
|---|---|---|---|---|
| Trip 1 | 0.5 | 0.3 | −0.5 | ... |
| Trip 2 | 0.7 | 0.4 | −0.6 | ... |
| Trip 3 | 0.3 | 0.2 | −0.3 | ... |
| ⋮ | ⋮ | ⋮ | ⋮ | ... |

1306 Abnormal acceleration history

| Trip \ Position | 0m | 10m | 20m | . . . |
|---|---|---|---|---|
| Trip 1 | 0.4 | 1.2 | −0.9 | . . . |
| Trip 2 | 0.6 | 0.9 | −1.0 | . . . |
| Trip 3 | 0.4 | 1.1 | −0.8 | . . . |
| . . . | . . . | . . . | . . . | . . . |

1501 Acceleration history

| Trip \ Position | 0m | 10m | 20m | ... |
|---|---|---|---|---|
| Trip | 0.3 | 1.1 | -0.8 | ... |
| ⋮ | ⋮ | ⋮ | ⋮ | ... |

SYSTEM AND METHOD FOR COLLECTING AND DISTRIBUTING TRAFFIC INFORMATION

CROSS-REFERENCE TO RELATED APPLICATION(S)

This application claims the foreign priority benefit under Title 35, United States Code, § 119 (a)-(d), of Japanese Patent Application No. 2006-240017, filed on Sep. 5, 2006 in the Japan Patent Office, the disclosure of which is herein incorporated by reference in its entirety.

BACKGROUND OF THE INVENTION

1. Field of the Invention

The present invention relates generally to systems and methods for collecting and distributing traffic information, and more particularly to a traffic information collection and distribution method, a traffic information collection and distribution system, a center apparatus, and a vehicle-installed terminal apparatus, for collecting and distributing traffic information based on probe data acquired by a sensor installed in a vehicle.

2. Description of the Related Art

Conventionally, probe cars are often used to acquire road traffic information. A probe car is a vehicle having various sensors and a vehicle-installed apparatus. The vehicle-installed apparatus includes a communication apparatus, etc. The probe car collects data, such as vehicle position, travel speed, travel distance, etc. (such data will hereinafter be referred to as "probe data") by means of the sensors, and transmits the collected probe data to a predetermined traffic information center by means of the communication apparatus. Any cars may be configured to serve as probe cars; to give a common example, taxis may be utilized as probe cars, with the cooperation of a taxi company.

Meanwhile, the traffic information center processes the probe data transmitted from the probe cars and collects traffic information, such as travel time between intersections, traffic congestion locations, traffic congestion lengths, etc. However, in actuality, because the number of probe cars is insufficient, there is a problem of accuracy of the collected traffic information. Thus, for example, there is an idea of making vehicles that have a navigation apparatus with a communication function serve the role of probe cars to increase the number of probe cars. Many present vehicles already have the sensors necessary for collecting traffic information, and it is predicted that navigation apparatuses with a communication function will increase further in the future.

When a large number of vehicles thus become probe cars and probe data are transmitted to the traffic information center from such a large number of probe cars, problems that differ from the conventional case occur. A first problem is that because probe data are transmitted from a large number of probe cars, the communication load on the communication line and the processing load on a computer of the traffic information center become enormous. A second problem is how different data on the same event on a road (for example, a traffic congestion at a certain location) that are transmitted from a plurality of probe cars should be classified or identified as being equivalent.

JP 2003-296891 A (Patent Document 1) discloses an example of a probe car, a vehicle-installed apparatus of which performs event detection, called "SS/ST," to reduce the data transmitted to a traffic information center. "SS (short stop)" refers to a stop state in which the speed of the vehicle is less than a predetermined speed, "ST (short trip)" refers to a travel state in which the speed of the vehicle is no less than the predetermined speed. Each time when an SS or ST event ends, the vehicle-installed apparatus uplinks the event status and probe data, such as the vehicle position, vehicle speed, etc. Hereupon, 'uplink' refers to data transmission from the vehicle-installed apparatus to the traffic information center. The "SS/ST" is an event-driven uplink method, and it has been shown that this method advantageously produces the effect of compression of the uplinked data.

In regard to the second problem mentioned above, a general method for resolving similar problems, e.g., adaptive resonance theory (ART), can be applied. That is, a computer configured to process probe data learns using training data that have been set in advance and forms clusters of data similar to the training data. Probe data that are input in real time are then matched with the clusters to detect and classify events.

However, with the event detection by SS/ST according to Patent Document 1, when there are differences in event detection conditions (such as travel circumstances and circumstances of the surroundings of vehicles), differences in vehicle type, differences among individual vehicles, differences in sensor type, differences among individual sensors, etc., large differences may arise in the probe data, which may thus make it difficult to merge (unify) events in the traffic information center. Also, even when information is compressed by SS/ST, we cannot expect the amount of uplinked information to be reduced because probe data are uplinked on all event occurrences under circumstances where the increase in the number of the probe cars and in the types and time resolution of sensors progresses.

If the adaptive resonance theory could be applied to probe data obtained by vehicles, the characteristics and order of the data subject to analysis would vary diversely within short time periods according to the number of vehicles, differences among individual vehicles, road travel characteristics, etc. Thus, unlike an application where the sensors for use in judgment are specified in advance, the setting of training data and the forming of clusters of data cannot be performed easily. In the least, it is difficult to perform real-time detection and classification of events from probe data that are input in real time.

It would thus be deemed desirable to provide a traffic information collection and distribution method, a traffic information collection and distribution system, a center apparatus, and a vehicle-installed terminal apparatus that can reduce the amounts of probe data uplinked from probe cars, and that can perform the process, in real time, of extracting similar feature data from a large number of probe data for a specific road section, associating event information concerning a traffic condition with the road section corresponding to the extracted feature data, and distributing the event information for the specific road section.

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

SUMMARY OF THE INVENTION

It is one aspect of the present invention to provide a system for collecting and distributing traffic information. The system comprises a vehicle-installed terminal apparatus and a center apparatus communicatively coupled with each other. The vehicle-installed terminal apparatus is installed in a vehicle and configured to acquire probe data (as created from sensor data received) from a sensor provided in the vehicle. The center apparatus comprises a temporary storage means configured to temporarily store information transmitted from the vehicle-installed terminal apparatus. The center apparatus is configured to acquire event information concerning traffic conditions of roads based upon the temporarily stored information. In another aspect of the present invention, a method for collecting and distributing information is provided which is implemented in the system for collecting and distributing traffic information. Still another aspect of the present invention is to provide a center apparatus for use in the system for collecting and distributing traffic information. Still another aspect of the present invention is to provide a vehicle-installed terminal apparatus for use in the system for collecting and distributing traffic information. According to an exemplary embodiment of the present invention, the vehicle-installed terminal apparatus and the center apparatus operate as follows:

(1) Upon detection of a certain event from the acquired probe data, the vehicle-installed terminal apparatus transmits relevant probe data concerning the road section for which the event has been detected, and event identification information by which the event is identifiable, to the center apparatus;

(2) The center apparatus (2-1) receives the probe data and the event identification information transmitted from the vehicle-installed terminal apparatus and temporarily stores the received probe data and event identification information in the temporary storage means, (2-2) performs a feature space projection process by principal component analysis on a plurality of probe data sharing a road section, selected among the probe data stored in the temporary storage means, (2-3) detects a point of change of direction of a feature space vector from the feature space vector obtained by the feature space projection process, (2-4) partitions the road section shared by the plurality of probe data at the detected change point, (2-5) assigns to each road section resulting from the partitioning, one of the event identification information corresponding to the plurality of probe data that include the road section, and (2-6) distributes the assigned event identification information and section information which indicates the location of the corresponding road section, to the vehicle-installed terminal apparatus;

(3) The vehicle-installed terminal apparatus receives the event identification information and the section information, and if a current position of the corresponding vehicle is included in the road section indicated by the section information, displays the event information indicated by the event identification information, on a display apparatus.

According to exemplary embodiments of the present invention, the amount of probe data uplinked from probe cars is reduced, and similar feature data can be extracted from a large number of probe data concerning a certain road section and event information related to a traffic condition can be associated with the road section corresponding to the extracted feature data and distributed in real time.

BRIEF DESCRIPTION OF THE DRAWINGS

Various aspects, other advantages and further features of the present invention will become more apparent by describing in detail illustrative, non-limiting embodiments thereof with reference to the accompanying drawings, in which:

FIG. 2 is a diagram of an arrangement of probe data, transmitted from a vehicle-installed terminal apparatus to a center apparatus, and event data, distributed from the center apparatus to the vehicle-installed terminal apparatus, in an exemplary embodiment of the present invention;

DETAILED DESCRIPTION OF THE EXEMPLARY EMBODIMENTS

Embodiments of the present invention will now be described in detail with reference to the drawings.

Figure 1:
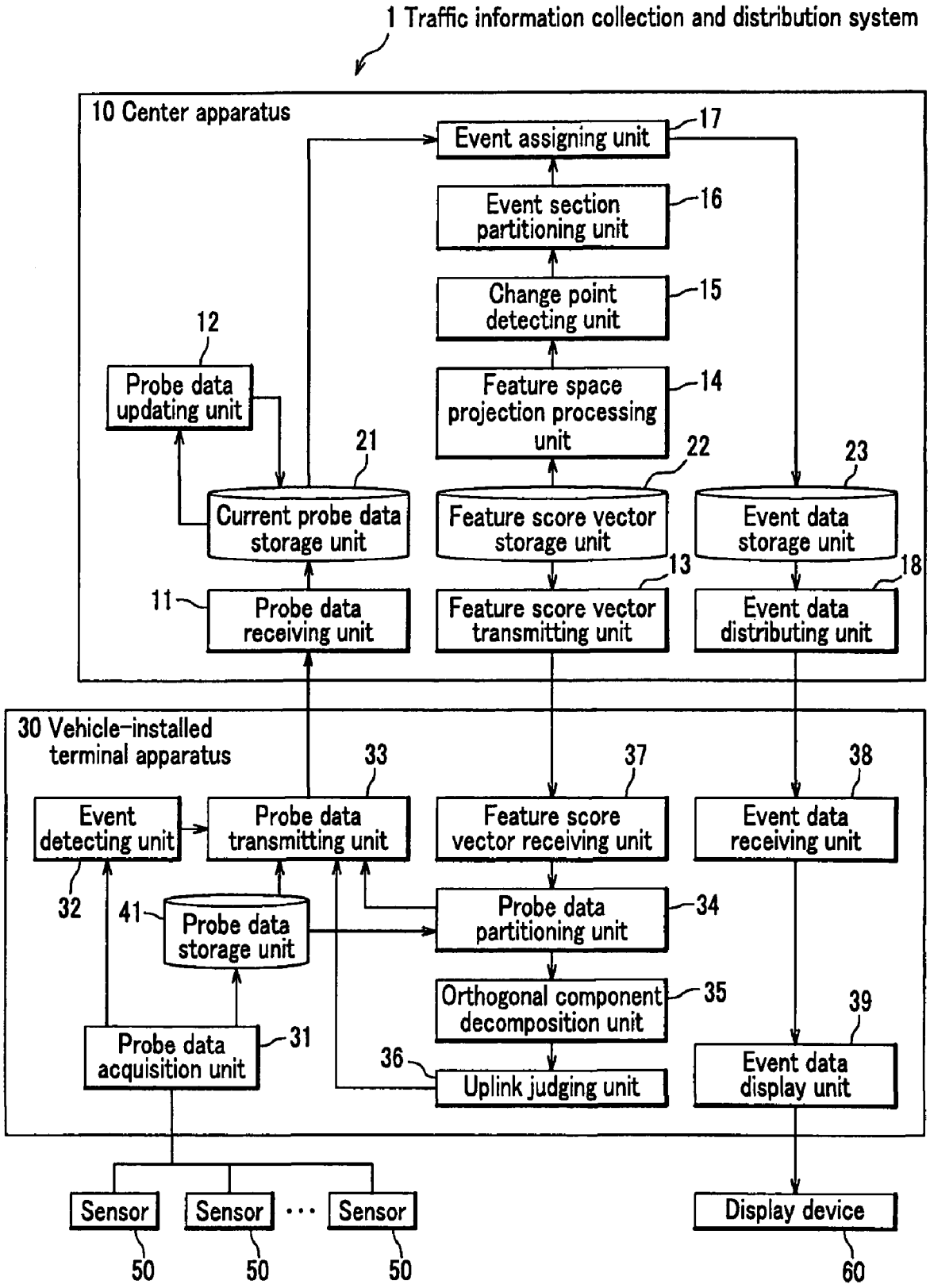
FIG. 1 is a diagram of an example of an arrangement of functional blocks of a traffic information collection and distribution system according to an exemplary embodiment of the present invention.

FIG. 1 is a diagram of an example of an arrangement of functional blocks of a traffic information collection and distribution system according to an exemplary embodiment of the present invention. As shown in FIG. 1, the traffic information collection and distribution system 1 comprises a center apparatus 10 and a vehicle-installed terminal apparatus 30, which is installed in a vehicle. Here, the center apparatus 10 and the vehicle-installed terminal apparatus 30 are communicatively coupled with each other via a communication network (not shown), such as a cellular phone line, the internet, etc. The vehicle-installed terminal apparatus 30 is connected to various sensors 50, a display device 60, and other components, which are installed in the vehicle.

Here, the center apparatus 10 comprises a probe data receiving unit 11, a probe data updating unit 12, a feature score vector transmitting unit 13, a feature space vector projection processing unit 14, a change point detecting unit 15, an event section partitioning unit 16, an event assigning unit 17, an event data distributing unit 18, a current probe data storage unit 21, a feature score vector storage unit 22, an event data storage unit 23, and other functional blocks.

The vehicle-installed terminal apparatus 30 comprises a probe data acquisition unit 31, an event detecting unit 32, a probe data transmitting unit 33, a probe data partitioning unit 34, an orthogonal component decomposition unit 35, an uplink judging unit 36, a feature score vector receiving unit 37, an event data receiving unit 38, an event data display unit 39, a probe data storage unit 41, and other functional blocks.

Various sensors that are generally installed in a vehicle can be used as the sensors 50. The sensors 50 may include any among a vehicle speed sensor, a distance sensor, an acceleration sensor, a brake sensor, an accelerator sensor, a steering angle sensor, a position sensor, such as a GPS (global positioning system) receiver, a slip sensor included in an ABS (antilock braking system), an obstacle sensor, such as a radar, etc.

In the vehicle-installed terminal apparatus 30, the probe data acquisition unit 31 is configured to acquire probe data input from the various sensors 50 and to store the acquired probe data in the probe data storage unit 41. The event detecting unit 32 is configured to detect an event from the probe data acquired by the probe data acquisition unit 31 and to attach an event label to the probe data. The event label is information indicating the type of the detected event, such as "traffic congestion". The probe data transmitting unit 33 is configured to transmit (uplink) the probe data with the event label attached, to the center apparatus 10, based on instruction information from the probe data partitioning unit 34 or the uplink judging unit 36.

In the present embodiment, the event detecting unit 32 is configured to detect an event by monitoring the probe data from one or more sensors 50. For example, a state in which the vehicle speed has become no more than a predetermined speed is detected as a "traffic congestion" event and a "traffic congestion" event label is attached to the probe data obtained in this state. Here, a plurality of event labels may be attached to the same probe data. The portion of the probe data to which the event label is attached is referred to as "event section."

In the vehicle-installed terminal apparatus 30, the feature score vector receiving unit 37 is configured to receive a feature score vector (the details of which will be described later) that is transmitted from the center apparatus 10, and the probe data partitioning unit 34 is configured to partition the probe data, stored in the probe data storage unit 41, into a portion included within a section corresponding to the received feature score vector and a portion outside this section. The probe data partitioning unit 34 is also configured to give instruction information to the probe data transmitting unit 33 to uplink the probe data of the portion outside the section. The orthogonal component decomposition unit 35 is configured to perform orthogonal component decomposition on the probe data of the portion included within the feature score vector section to extract a component (orthogonal component) that differs from the feature score vector. The uplink judging unit 36 is configured to judge whether or not data of the orthogonal component is present, and if data of the different component is present, to give instruction information to the probe data transmitting unit 33 to uplink the orthogonal component data extracted from the probe data to the center apparatus 10.

In the vehicle-installed terminal apparatus 30, the event data receiving unit 38 is configured to receive event data transmitted from the center apparatus 10. The received event data has attached thereto section information indicating to which road section the event data corresponds. The event data display unit 39 is configured to display event data of the road section in which the corresponding vehicle (the vehicle in which the terminal apparatus 30 is installed) is traveling, on the display device 60, if the received event data include relevant event data. The display device 60 may, for example, include an LCD (liquid crystal display), and a display device of a navigation apparatus installed in the vehicle may be used in common as the display device 60.

In the center apparatus 10, the probe data receiving unit 11 is configured to receive the probe data transmitted from the vehicle-installed terminal apparatus 30 and stores the received probe data in the current probe data storage unit 21. The probe data updating unit 12 is configured to remove, from among the probe data stored in the current probe data storage unit 21, the probe data for which date/time information (time stamp) attached thereto are outside a current time window. Here, the current time window refers to a period of time between the current time and a time preceding a predetermined amount of time (e.g., 5 minutes) ahead of the current time. The probe data updating unit 12 thus removes old data from among the probe data stored in the current probe data storage unit 21.

The feature space projection processing unit 14 is configured to perform a principal component analysis process on the probe data stored in the current probe data storage unit 21, to compute a feature space vector and a feature score vector, and to store the computed feature score vector in the feature score vector storage unit 22. The change point detecting unit 15 is configured to detect a point of change of direction of the computed feature space vector. The event section partitioning unit 16 is configured to partition a road section based on the change point, and the event assigning unit 17 is configured to assign an event label, attached to the probe data, to each subsection of the road section resulting from the partitioning and to store the road section information and the event label as event data in the event data storage unit 23. The event data distributing unit 18 is configured to distribute the event data, stored in the event data storage unit 23, to the vehicle-installed terminal apparatus 30.

Functions of the respective functional blocks from the feature space projection processing unit 14 onward in the center apparatus 10 will be described in more detail below.

In FIG. 1, the center apparatus 10 is constituted of a computer (not shown) including a CPU (central processing unit) and a storage device, and the functions of the abovementioned functional blocks of the center apparatus 10 are realized by the CPU executing predetermined programs stored in the storage device. The storage device may include a RAM (random access memory), flash memory, or hard disk device, etc.

Likewise, the vehicle-installed terminal apparatus 30 is constituted of a computer (not shown) including a CPU and a storage device, and the functions of the abovementioned functional blocks of the vehicle-installed terminal apparatus 30 are realized by the CPU executing predetermined programs stored in the storage device. The storage device may include a RAM, flash memory, or hard disk device, etc.

FIG. 2 is a diagram of an arrangement of probe data, transmitted from the vehicle-installed terminal apparatus to the center apparatus, and event data, distributed from the center apparatus to the vehicle-installed terminal apparatus, in an exemplary embodiment of the present invention.

In FIG. 2, the date/time information of the probe data is information expressing the date and time at which the probe data were acquired. The section information is related to a road section in a road link (a road joining intersections is referred to as a "road link") for which the probe data were acquired and includes identification information of the road link, information on a position of occurrence of an event in the road link, distance information of the section in which the probe data, related to the event, are present, etc. The event label is information that identifies the type of event and is attached by the event detecting unit 32.

If the vehicle-installed terminal apparatus 30 does not have road map information that includes identification information, position information, etc., of road links, the road link identification information cannot be attached by the vehicle-installed terminal apparatus 30. In this case, latitude and longitude information obtained from a GPS receiver, etc., may be used as the event occurrence position information and arrangements may be made to attach the road link identification information at the center apparatus 10.

The main body of the probe data is constituted of data $d_{ij}$ (j=1, . . . , n; where n is the number of data) acquired from sensors #i (i=1, . . . , s; where s is the number of sensors). The data $d_{ij}$, acquired from each sensor #i, may generally be data acquired as time series data, and the data $d_{ij}$ employed in the present embodiment are, for example, data resulting from conversion of time series data made with data from a travel distance sensor into data based on travel distance, i.e., data obtained each time the vehicle travels for a distance of 1 m, for example.

The probe data that are uplinked when uplinking is instructed by the uplink judging unit 36 are not the data $d_{ij}$, acquired by the sensors #i (i=1, . . . , s), but are the orthogonal component data extracted by the orthogonal component decomposition unit 35 from the probe data for the section included in the feature score vector.

The event data that are distributed from the center apparatus 10 to the vehicle-installed terminal apparatus 30 include date/time information, section information, and an event label. Here, the section information includes the road link identification information and position information of at least two points in the road link. The event label is the event label assigned to the section by the event assigning unit 17, and a plurality of event labels may be assigned.

A plurality of the event data arranged as described above are stored in the event data storage unit 23. Although the event data distributing unit 18 may distribute the event data to each vehicle-installed terminal apparatus 30 individually, normally, the event data distributing unit 18 performs multicasting, etc., to simultaneously distribute event data that include section information of road sections within a predetermined area to a plurality of vehicle-installed terminal apparatuses present in that area.

Figure 3:
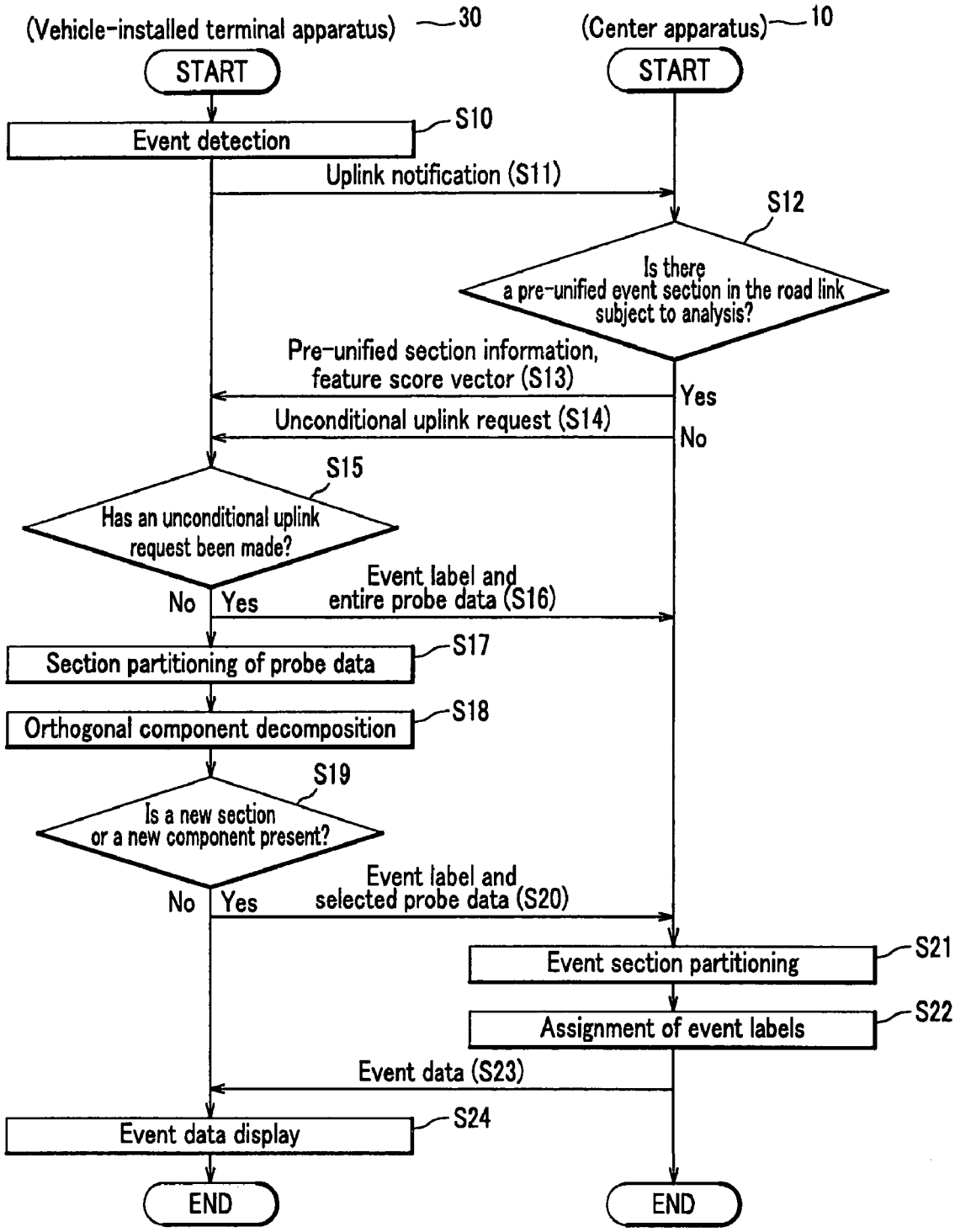
FIG. 3 is a diagram of an outline of a process flow of the traffic information collection and distribution system according to an exemplary embodiment of the present invention.

FIG. 3 is a diagram showing an outline of a process flow of the traffic information collection and distribution system according to an exemplary embodiment of the present invention. This process flow outlines the process of the vehicle-installed terminal apparatus 30 acquiring probe data from the sensors 50, detecting an event from the probe data, and uplinking just the minimum necessary probe data to the center apparatus 10, and the process of the center apparatus 10 unifying or separating the uplinked probe data with or from the event data stored up until then to generate new event data, and distributing the stored and generated event data. This process is premised on the presence of a plurality (large number) of vehicle-installed terminal apparatuses 30.

As shown in FIG. 3, when a vehicle-installed terminal apparatus 30 detects an event, such as a traffic congestion, from the probe data acquired from the sensors 50 (step S10), the vehicle-installed terminal apparatus 30 transmits an "uplink notification" to the center apparatus 10 (step S11). The "uplink notification" notifies that the vehicle-installed terminal apparatus 30 is about to uplink probe data to the center apparatus 10. In the present embodiment, the "uplink notification" may be considered to be information that requests, to the center apparatus 10, the transmission of a feature score vector. Information on the current position of the vehicle, in which the vehicle-installed terminal apparatus 30 is installed, is attached to the "uplink notification."

Upon receiving the "uplink notification," the center apparatus 10 references the feature score vector storage unit 22 based on the attached current position information of the vehicle and judges whether or not a pre-unified event section is present in the road link in which the vehicle is traveling (step S12). Here, the pre-unified event section refers to a road section with which a feature score vector has been associated, and the details of this will be described later.

If it is found as a result of judgment that a pre-unified event section is present ("Yes" in step S12), then the center apparatus 10 transmits a feature score vector that includes the pre-unified event section information to the vehicle-installed terminal apparatus 30 (step S13). If it is found that a pre-unified event section is not present ("No" in step S12), then the center apparatus 10 transmits an "unconditional uplink request" to the vehicle-installed terminal apparatus 30 (step S14).

Meanwhile, If the data received by the vehicle-installed terminal apparatus 30 is the "unconditional uplink request" ("Yes" in step S15), then the vehicle-installed terminal apparatus 30 uplinks the entire probe data related to the event and including the event label, to the center apparatus 10 (step S16). If the data received is not the "unconditional uplink request" ("No" in step S15), that is, if the data received is a feature score vector that includes pre-unified section information, then the vehicle-installed terminal apparatus 30 performs section partitioning of the probe data based on the pre-unified section information (step S17).

If a new section that is not included in the pre-unified section arises as a result of the section partitioning, the probe data of the new section is extracted. In regard to the probe data included within the pre-unified section, orthogonal component decomposition based on the feature score vector is performed (step S18), and an orthogonal component is extracted as a new component of the event. If a new section or a new component (orthogonal component) of probe data is extracted ("Yes" in step S19), then the vehicle-installed terminal apparatus 30 uplinks the probe data of the extracted portion, including the event label, to the center apparatus 10 (step S20). If a neither a new section nor a new component is extracted ("No" in step S19), then uplinking of probe data is not performed.

Upon receiving the probe data uplinked from the vehicle-installed terminal apparatus 30 (the entire probe data or the probe data of the new section or the new component), the center apparatus 10 stores the probe data once in the probe data storage unit 21, performs a feature space projection process on the probe data belonging to a new unified event section that includes the pre-unified event section and the new section to detect a change point of the feature space vector, and thereby partitions the event section (step S21). The center apparatus 10 then assigns an event label to the each event section resulting from the partitioning and stores the section information of the event sections, in association with the event labels, in the event data storage unit 23 (step S22).

Also, at every predetermined time, for example, every 5 minutes, the center apparatus 10 distributes, to the vehicle-installed terminal apparatus 30, the event data stored in the event data storage unit 23 (step S23). The vehicle-installed terminal apparatus 30 receives the distributed event data, compares the section information, included in the received event data, with the current position of the corresponding vehicle, and if there is any event data having section information that covers the current position, displays the pertinent event data on the display device (step S24).

By the process shown in FIG. 3, the center apparatus 10 can collect event data, that is, traffic information from the vehicle-installed terminal apparatus 30 installed in each of a plurality of vehicles traveling along roads, and can distribute the collected traffic information to the vehicle-installed terminal apparatuses 30. Thus, even before detecting an event on its own, a vehicle-installed terminal apparatus 30 can acquire event data, that is, traffic information detected by another vehicle-installed terminal apparatus 30.

Processes, within the above-described process, that characterize the present embodiment will now be described in further detail by way of examples.

Figure 4:
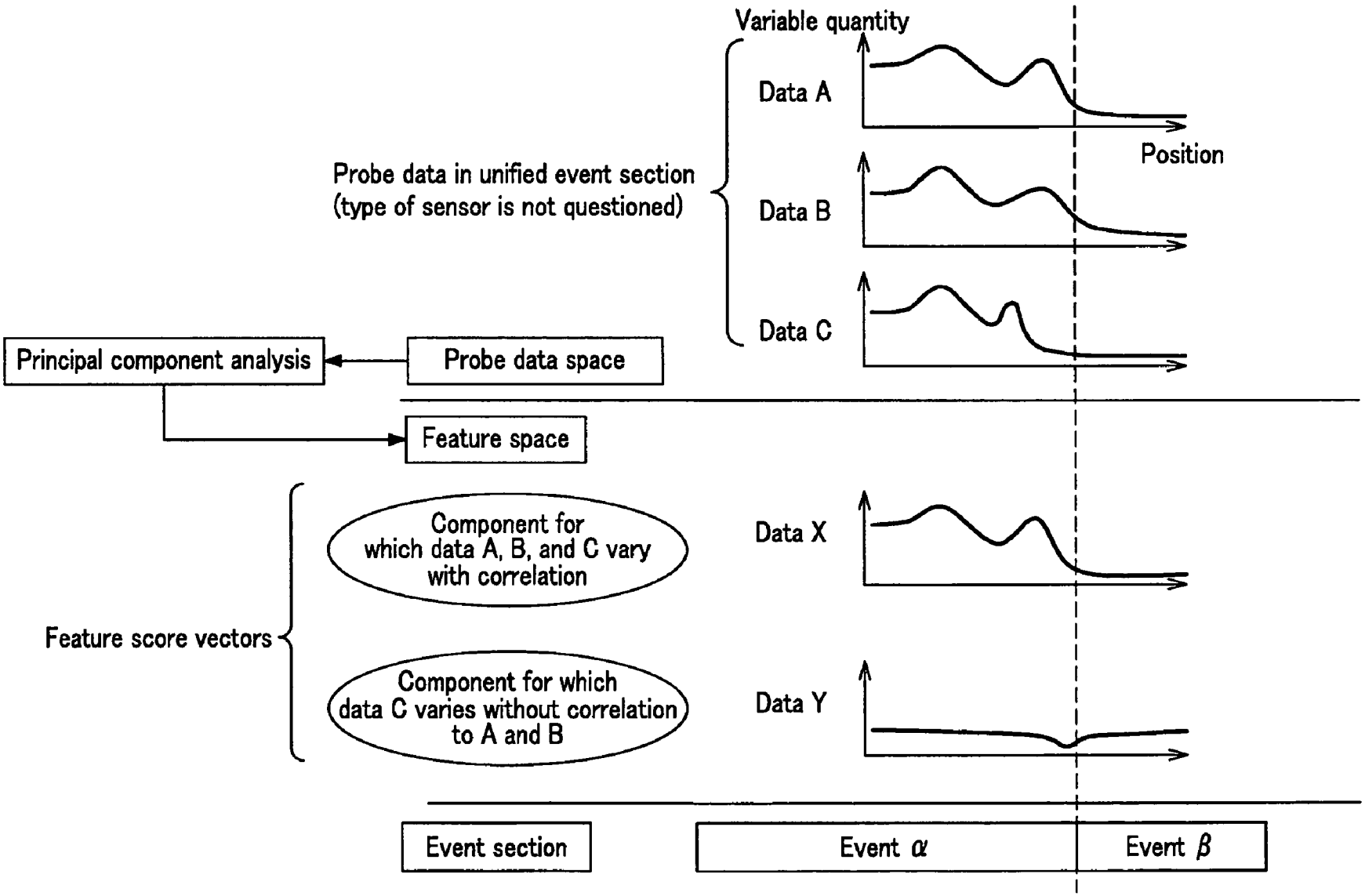
FIG. 4 is a schematic diagram of an example of a feature space projection process in a principal component analysis according to an exemplary embodiment of the present invention.

FIG. 4 is a schematic diagram of an example of the feature space projection process in the principal component analysis according to an exemplary embodiment of the present invention. The principal component analysis is an art by which mutually correlated data are extracted from a large number of data and unified to reduce the data amount so that the features of the data can be grasped readily. Because probe data that are acquired for the same event by the vehicle-installed terminal apparatuses 30 of a plurality of vehicles can obviously be considered to be highly correlated, these probe data can be unified by application of the principal component analysis.

For example, assume that the probe data of data A, data B, and data C are acquired by a plurality of vehicle-installed terminal apparatuses 30 as shown in FIG. 4. Here, the data A, B, and C are extremely highly correlated. These data can thus be deemed to be formed by the same event. However, data C is large in change rate of the data due, for example, to individual differences of the vehicles and is slightly low in correlation with data A and data B.

When the principal component analysis is applied to such data A, B, and C, the data can be converted to so-called feature space data, with which the number of types of data is reduced. Such a data conversion is often called feature space projection. In FIG. 4, the data A, B, and C are converted to data X that is a component in which the data A, B and C change in a correlated manner, and to data Y that is a component in which the data C changes without correlation with the data A and B. Coordinate axes of a feature space are thus selected to represent data of high correlation.

In the center apparatus 10 of the present embodiment, such a feature space projection is performed by the feature space projection processing unit 14. The data X and the data Y, obtained by the data A, B, and C, in probe data space, being projected onto the feature space, are respectively called feature score vectors. Put in another way, feature score vectors indicate history information of coordinate values of data in a feature space in accordance with the respective coordinate axes. The feature score vectors obtained by the feature space projection are stored in the feature score vector storage unit 22.

Coordinate values expressed by data in a feature space are referred to as a feature space vector, and in the present embodiment, a change of direction of a feature space vector is captured and judged to be a change point of an event. With the example in FIG. 4, the data X are large in norm (the absolute value of the magnitude of the vector) and are data that are affected more by the corresponding event. The data Y are small in norm and is data that are affected less by the corresponding event. In the synthesis of a plurality of vectors, because the direction of the synthesized vector is influenced by the direction of the vector of large norm, the direction of the feature space vector in the present case is largely influenced by the value of the data X. Thus, in the example of FIG. 4, because the value of the data X changes greatly near the position indicated by the broken line, the feature space vector also changes greatly near the broken line.

Thus, in the present embodiment, the change point of the feature space vector is detected and the event section is partitioned by the change point. With the example of FIG. 4, the section before the broken line is deemed to be an event $\alpha$ and the section after the broken line is deemed to be an event $\beta$. In the center apparatus 10, these processes are performed at the change point detecting unit 15 and the event section partitioning unit 16.

Here it is supplementarily noted that a distinction should be made between the feature score vector and the feature space vector. For example, let $d_{ij}$ (i=1, . . . , s; j=1, . . . , n) be the probe data and $c_{kj}$ (k=1, . . . , u; j=1, . . . , n; u<s) be the feature space data resulting from conversion of the probe data by the feature space projection. In this case, if $c_{kj}$ are elements of an array C, the column vectors $(c_{1j}, c_{2j}, \ldots, c_{uj})^t$ (j=1, . . . , n) are the feature space vectors and the row vectors $(c_{k1}, c_{k2}, \ldots, c_{kn})$ (k=1, . . . , u) are the feature score vectors.

Figure 5:
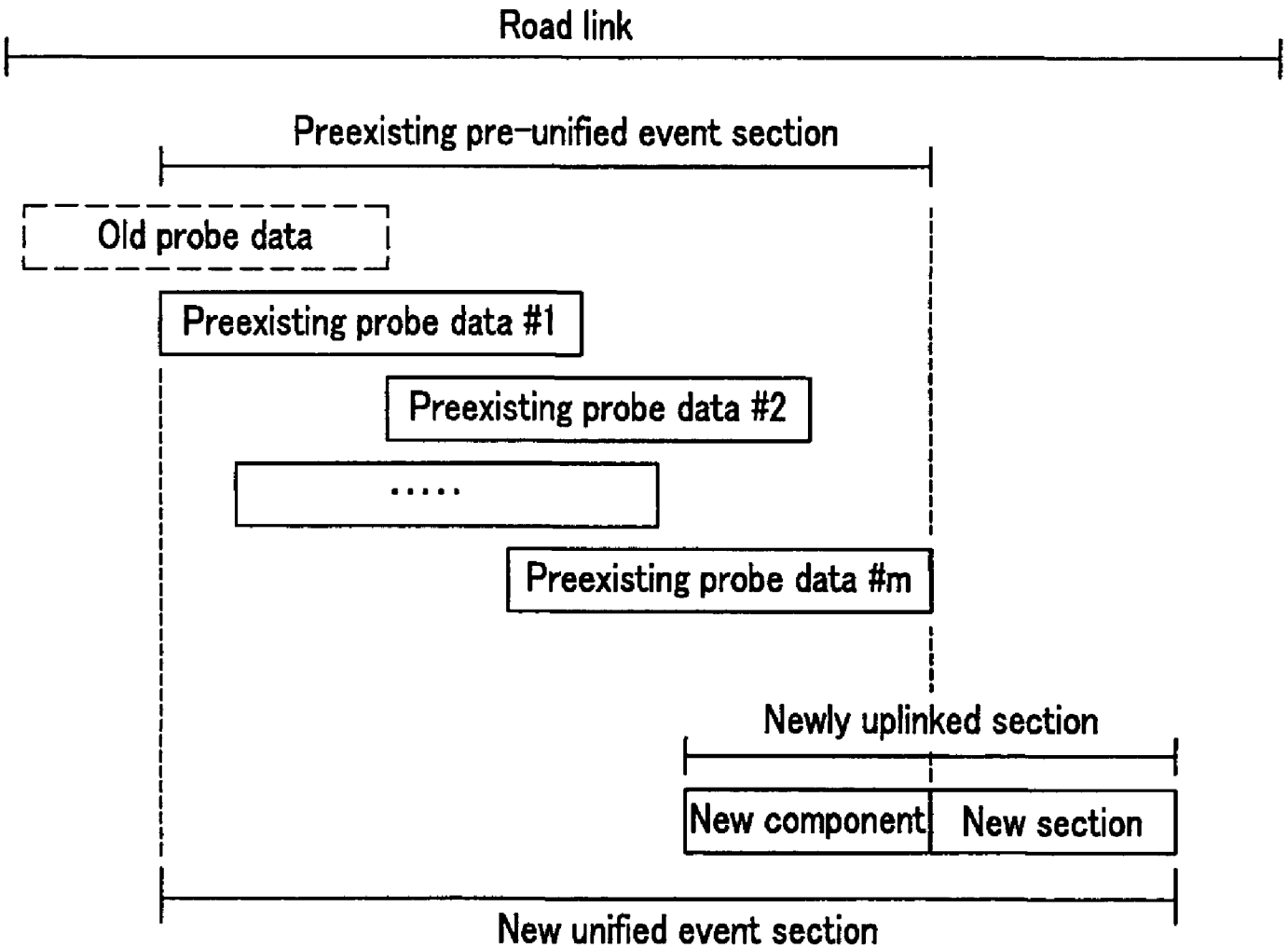
FIG. 5 is a diagram of concepts of unified event section determination in the center apparatus according to an exemplary embodiment of the present invention.

FIG. 5 is a diagram of concepts of unified event section determination in the center apparatus according to an exemplary embodiment of the present invention. In many cases where new probe data are uplinked from a vehicle-installed terminal apparatus 30 to the center apparatus 10, probe data that have been uplinked from vehicle-installed terminal apparatuses 30 of preceding vehicles are already present in the current probe data storage unit 21 of the center apparatus 10. In FIG. 5, such probe data are expressed as preexisting probe data #1, #2, . . . , #m.

Also, as shown in FIG. 5, due to crowding circumstance of a road, vehicle travel circumstances, etc., the event sections of the preexisting probe data #1, #2, . . . , #m are shifted in position. However, as long as there is overlap among the event sections, the center apparatus 10 deems the probe data to originate from the same event and performs the feature space projection process with the overlapping event sections unified to a section that includes all of the overlapping event sections.

Thus, when new probe data are uplinked, the event sections of the preexisting probe data #1, #2, . . . , #m that had been uplinked before are unified in accordance with the preexisting probe data. Thus, in the present embodiment, the event section, resulting from the unification of the event sections of the probe data that are already present when the new probe data are uplinked, is referred to as the "pre-unified event section."

When the new probe data are uplinked, the center apparatus 10 forms a new unified event section by logical addition of the pre-unified event section and the event section of the new probe data, and performs the feature space projection on the preexisting probe data #1, #2, . . . , #m and the new probe data. Here, if probe data, for which a time no less than a predetermined time has elapsed, are present in the pre-unified event section, the old probe data are excluded from the feature space projection process.

When the feature space projection process is performed on probe data that differ in event section range as shown in FIG. 5, each piece of probe data has missing values with respect to the unified event section to be subject to the feature space projection process. In regard to this point, in the present embodiment, principal component analysis with missing values, in which the values of the missing sections are estimated and supplemented, is applied though the calculation amount becomes large.

Figure 6:
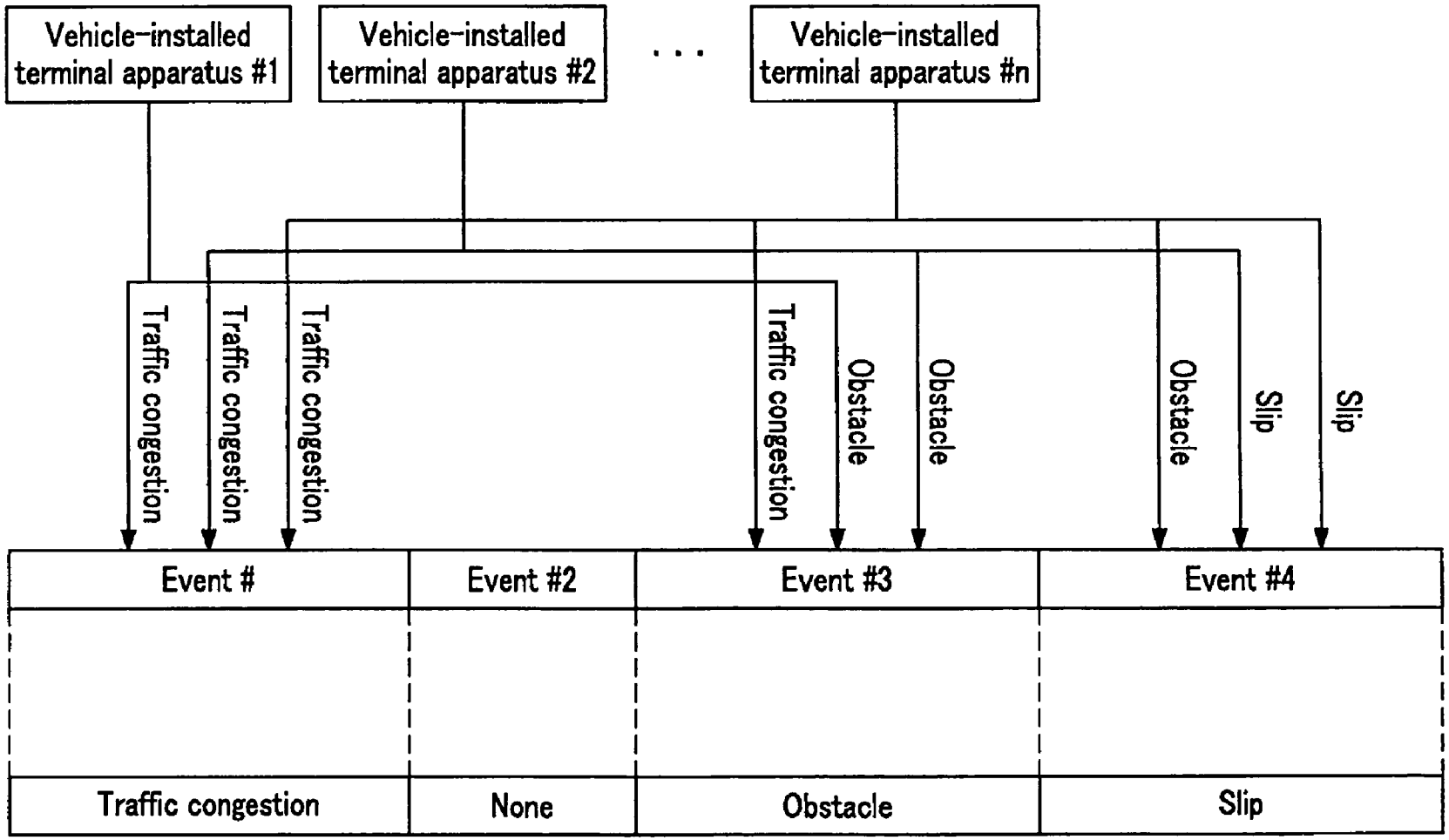
FIG. 6 is a diagram of an example of event label assignment in the center apparatus according to an exemplary embodiment of the present invention.

FIG. 6 is a diagram of an example of event label assignment in the center apparatus according to the present embodiment.

Upon receiving the uplink of the probe data, the center apparatus 10 performs the feature space projection process on the new unified event section as described above, detects a change point of a feature space vector, and partitions the event section. The center apparatus 10 then assigns an event label to each event section (subsection) resulting from the partitioning.

In assigning an event label, it is judged whether or not the same event label had been assigned to all of the probe data subject to the unification. If the same event label had been assigned, the event label is assigned to the corresponding event section resulting from the partitioning. If the same event label had not been assigned, that is, if different event labels are mixed, the most frequently occurring event label is selected by a majority vote and the most frequently occurring event label is assigned to the corresponding event section.

In FIG. 6, because the event labels assigned to the probe data of the event section of an event #1 are all "traffic congestion," the "traffic congestion" event label is assigned to the event section of the event #1. Also, by majority votes, the event labels of "obstacle" and "slipping" are assigned to the event sections of an event #3 and an event #4, respectively.

Figure 7:
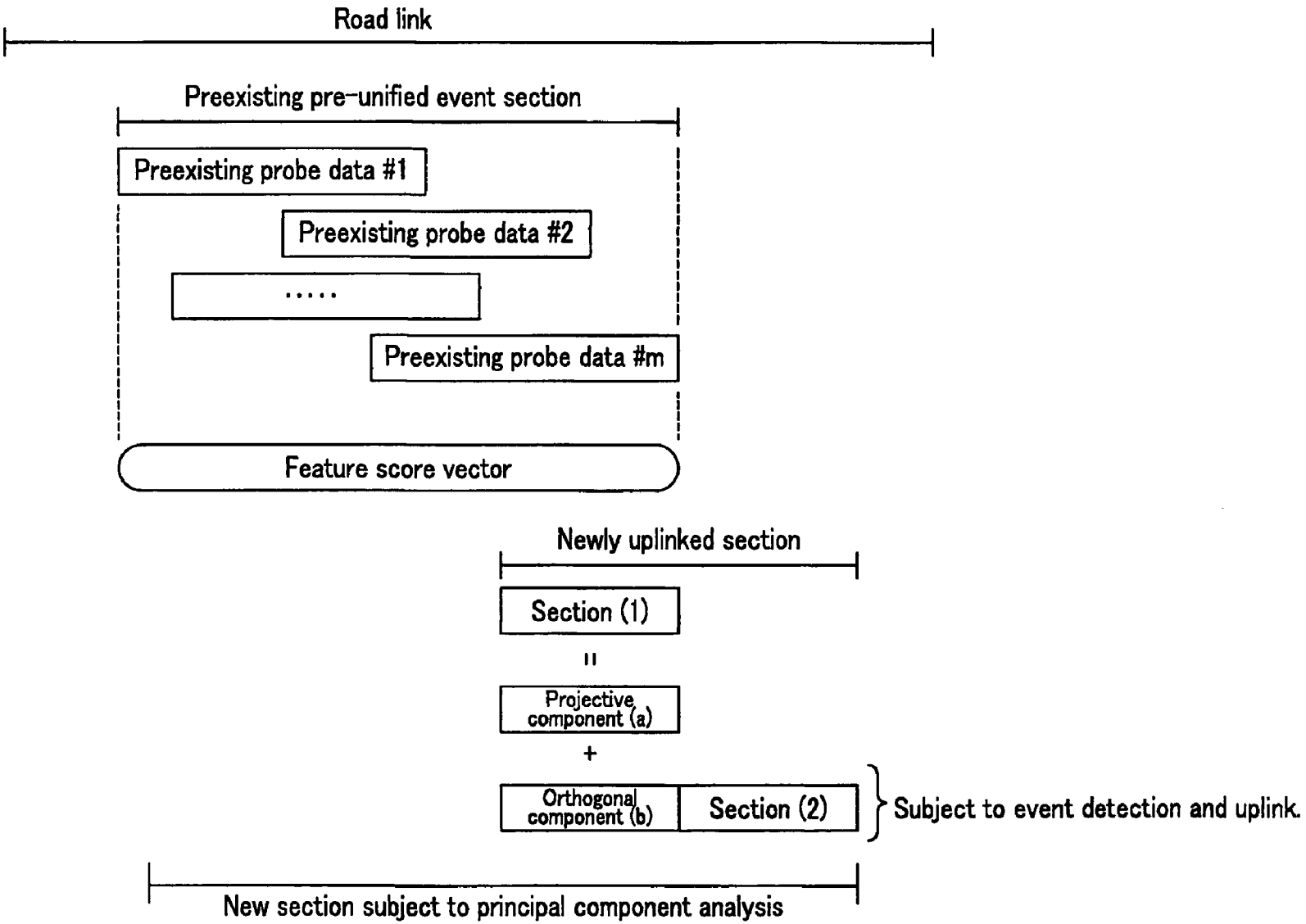
FIG. 7 is a diagram of an example of probe data partitioning and orthogonal component decomposition in the vehicle-installed terminal apparatus according to an exemplary embodiment of the present invention.
Figure 8:
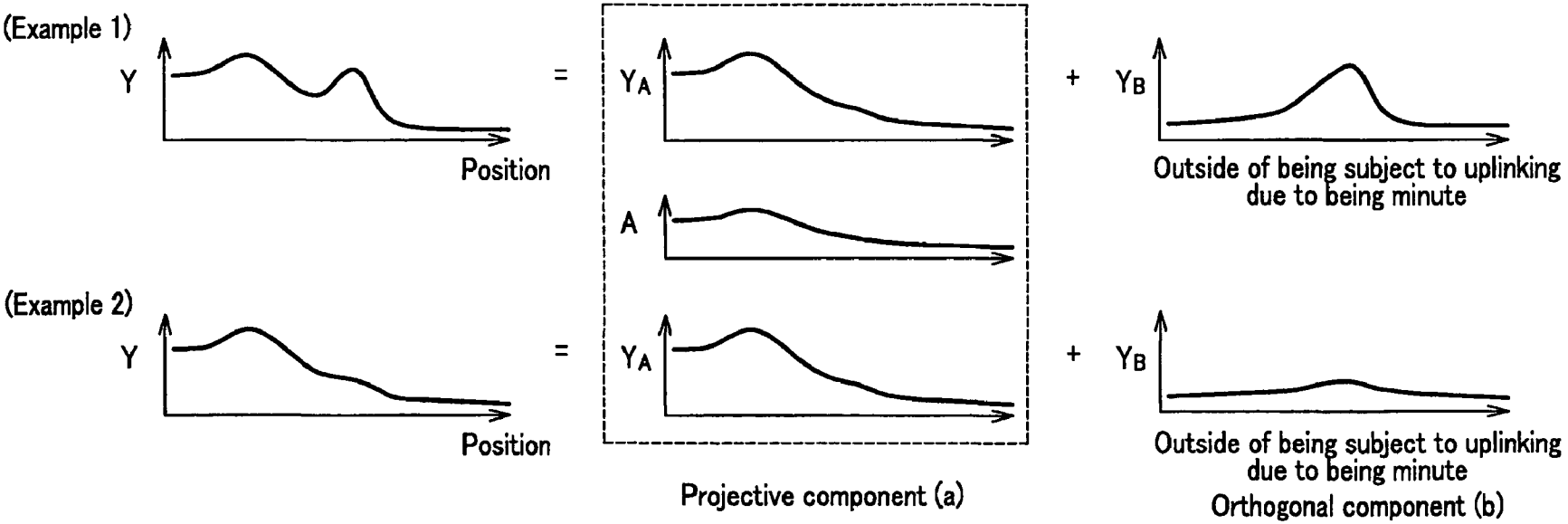
FIG. 8 is a diagram of basic concepts of orthogonal component decomposition of probe data in the vehicle-installed terminal apparatus according to an exemplary embodiment of the present invention.

FIG. 7 is a diagram of an example of probe data partitioning and orthogonal component decomposition in the vehicle-installed terminal apparatus according to the present embodiment, and FIG. 8 is a diagram of basic concepts of the orthogonal component decomposition.

As mentioned above, in uplinking probe data, a vehicle-installed terminal apparatus 30 transmits the "uplink notification" to the center apparatus 10. In response, the center apparatus 10 judges whether a preexisting pre-unified event section is present in the road link in which the vehicle, in which the vehicle-installed terminal apparatus 30 is installed, is traveling, and if an existing pre-unified event section is present, transmits, to the vehicle-installed terminal apparatus 30, a feature score vector that had already been obtained by the feature space projection process performed on the preexisting probe data included in the pre-unified event section.

The vehicle-installed terminal apparatus 30 receives the feature score vector and compares the event section of the received feature score vector and the event section (hereinafter referred to as the "newly uplinked section") of the probe data that are about to be uplinked. Then as shown in FIG. 7, the newly uplinked section is partitioned into a section (1) that is included in the event section of the feature score vector and a section (2) that is not included in the event section of the feature score vector (probe data partitioning unit 34). Meanwhile, in regard to the probe data for the section (1), the probe data are projected onto a base vector of the received feature score vector and decomposed into a projective component (a) and an orthogonal component (b) that is orthogonal to the base vector of the feature score vector (orthogonal component decomposition unit 35). In regard to the probe data for the section (2), because there is the possibility that these data contain event information that are not included in the pre-unified event section up until now, the probe data are subject to uplinking.

In FIG. 8, when the feature score vector is A, probe data, such as that of Y of (Example 1), is decomposed into a projective component $Y_A$, projected onto the base vector, and a component $Y_B$ that is orthogonal to $Y_A$. That is, because the orthogonal component $Y_B$ signifies having some event information that is not contained in the feature score vector A, the orthogonal component $Y_B$ is subject to the uplink. However, if as in Y of (Example 2) of FIG. 8, even though an orthogonal component $Y_B$ is present, the norm thereof is small, it is judged that a corresponding event is not present and the probe data is not subject to the uplink. The vehicle-installed terminal apparatus 30 sets an appropriate threshold value and compares the norm of the extracted orthogonal component $Y_B$ with the threshold value to judge whether or not an orthogonal component is present.

As described above, if the norm of the orthogonal component does not reach the predetermined threshold value, the vehicle-installed terminal apparatus 30 judges that the probe data of the corresponding portion has no new information besides the event information that the center apparatus has already and removes the probe data from being subject to uplinking. The amount of probe data uplinked from the vehicle-installed terminal apparatus 30 to the center apparatus 10 can thereby be reduced.

Figure 9:
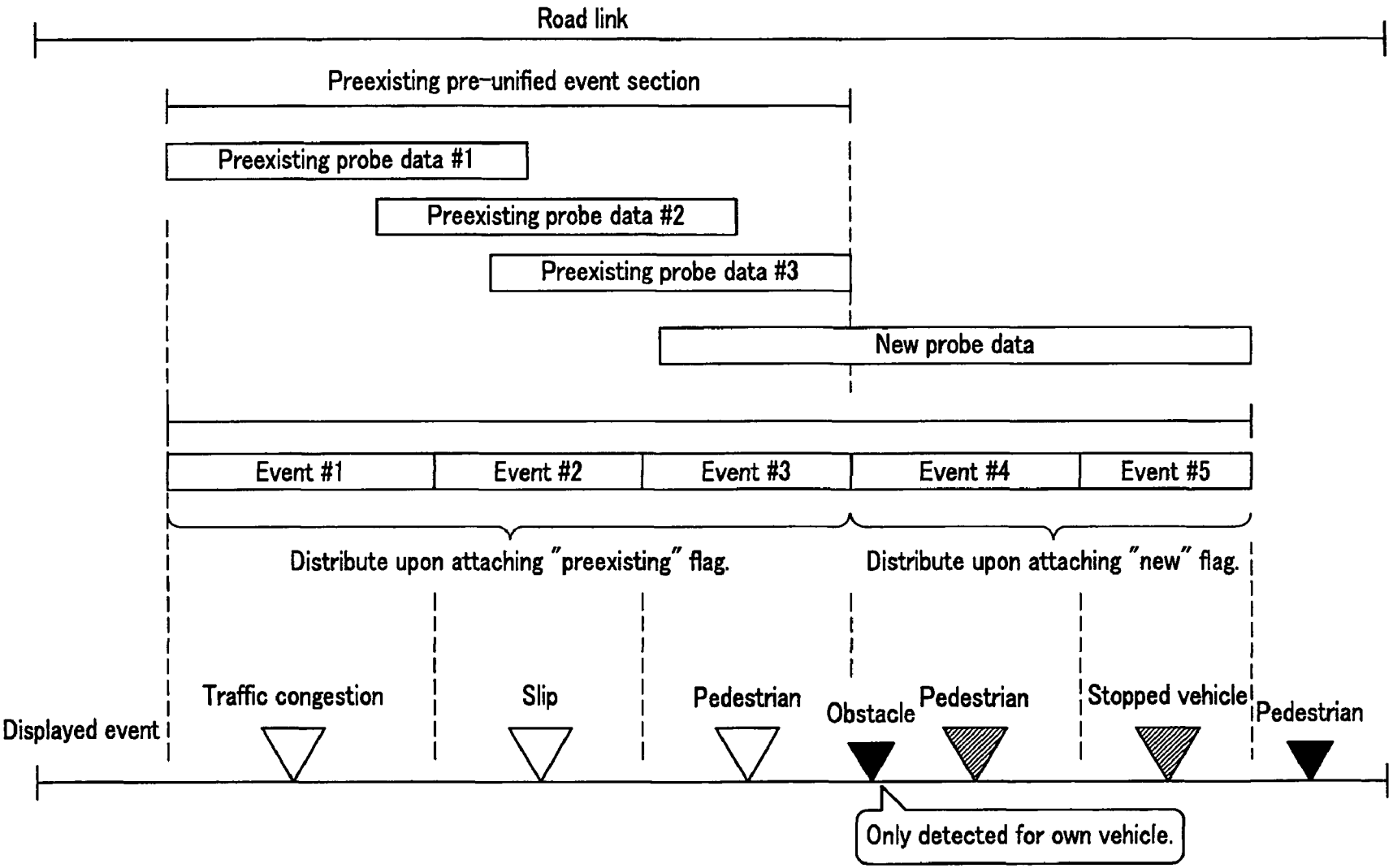
FIG. 9 is a diagram of an example of a method of displaying event data in the vehicle-installed terminal apparatus according to an exemplary embodiment of the present invention.

FIG. 9 is a diagram of an example of a method of displaying event data in the vehicle-installed terminal apparatus according to an exemplary embodiment of the present invention.

The vehicle-installed terminal apparatus 30 receives the event data distributed from the center apparatus 10 and displays the received event data on the display device of the vehicle-installed terminal apparatus 30. In this process, as shown in FIG. 9, the center apparatus 10 distributes events #1, #2, and #3 which are assigned according to a preexisting pre-unified event section, with a "preexisting flag" attached thereto, and distributes events #4 and #5 which are assigned according to new probe data, with a "new flag" attached thereto. The vehicle-installed terminal apparatus 30 displays the event data, provided with the "preexisting flag," and the event data, provided with the "new flag," in a manner that is mutually distinguishable by color, shape, etc., on the display device.

If there is an event that is not included in the distributed event data among the events detected by the vehicle-installed terminal apparatus 30 itself, the vehicle-installed terminal apparatus 30 displays the event detected on its own, on the display device in a manner enabling distinction from the distributed events by means of color, shape, etc.

Figure 10:
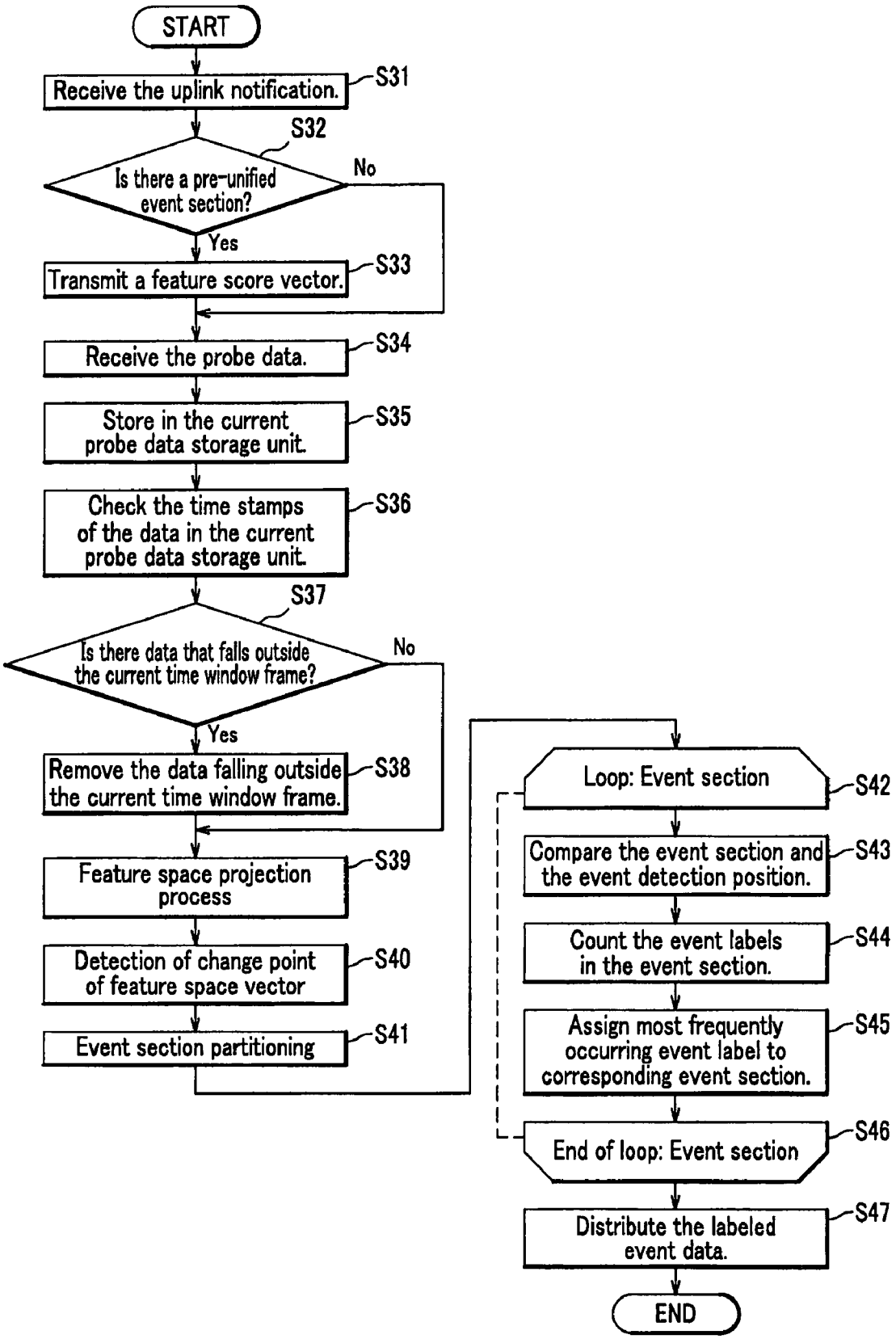
FIG. 10 is a diagram of an operation flow of the center apparatus according to an exemplary embodiment of the present invention.

FIG. 10 is a diagram of an operation flow of the center apparatus according to an exemplary embodiment of the present invention. As shown in FIG. 10, upon receiving the uplink notification transmitted from a vehicle-installed terminal apparatus 30 (step S31), the center apparatus 10 references the feature score vector storage unit 22 based on the current position information of the corresponding vehicle that is attached to the uplink notification and judges whether or not there is a pre-unified event section in the road link in which the vehicle is traveling (step S32). If there is a pre-unified event section in the road link ("Yes" in step S32), then the center apparatus 10 transmits a feature score vector related to the pre-unified event section to the vehicle-installed terminal apparatus 30 (step S33). On the other hand, if there is no pre-unified event section ("No" in step S32), then the unconditional uplink request is transmitted to the vehicle-installed terminal apparatus 30 (not shown, but corresponding to step S14 in FIG. 3).

Next, when the center apparatus 10 receives the probe data transmitted from the vehicle-installed terminal apparatus 30 (step S34), the center apparatus 10 stores the received probe data in the current probe data storage unit 21 (step S35). The center apparatus 10 then checks the time stamps of the data (probe data) stored in the current probe data storage unit 21 (step S36) and judges whether or not there are any data that fall outside the current time window frame (step S37). If as a result of judgment, data that fall outside the current time window frame are found ("Yes" in step S37), then the data falling outside the current time window frame are removed from the current probe data storage unit 21 (step S38).

The center apparatus 10 then performs the feature space projection process by principal component analysis on the probe data included in a unified event section formed by the event section of the received probe data and the pre-unified event section (step S39). The center apparatus 10 performs change point detection of a feature space vector obtained by the feature space projection process (step S40) and furthermore partitions the event section based on the change point (step S41).

The center apparatus 10 then performs a loop process of step S42 to step S46 to assign event labels to the respective event sections resulting from the partitioning (see FIG. 6). In this loop process, the center apparatus 10 compares the respective event sections with the event detection positions attached to the probe data (step S43) and counts the event labels attached to the probe data in the event sections (step S44). The most frequently occurring event label among the event labels in the event section is then assigned as a representative event label of the event section (step S45).

Lastly, the center apparatus 10 distributes the event data, which have been labeled by the event label assignment process described above, to the vehicle-installed terminal apparatus 30 (step S47). Although a single piece of event data that is distributed is arranged as shown in FIG. 2, when the event data according to the preexisting probe data and the event data according to the new probe data are to be distinguished as shown in FIG. 9, the identification flag (the "preexisting" flag and the "new" flag) are attached thereto.

Figure 11:
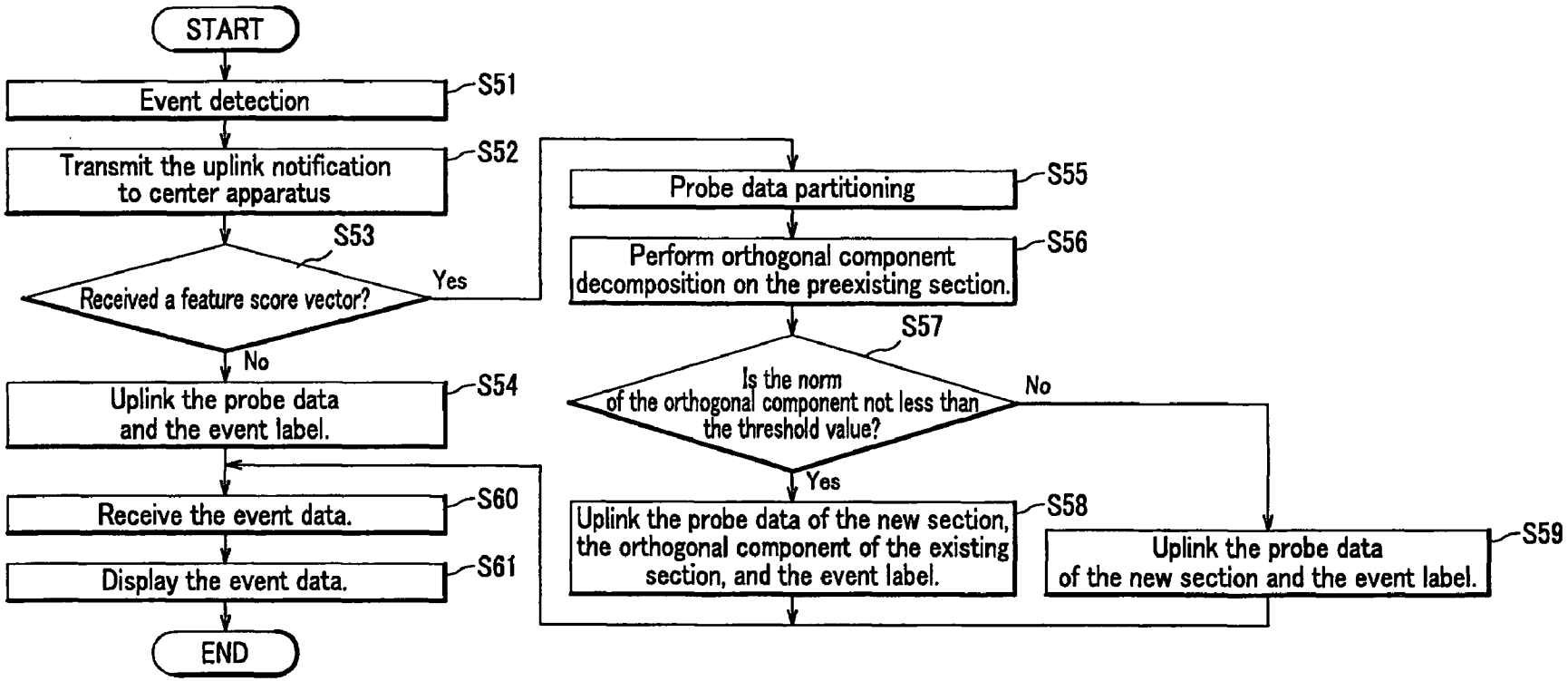
FIG. 11 is a diagram of an operation flow of a vehicle-installed terminal apparatus according to an exemplary embodiment of the present invention.

FIG. 11 is a diagram of an operation flow of a vehicle-installed terminal apparatus according to an exemplary embodiment of the present invention. As shown in FIG. 11, when the vehicle-installed terminal apparatus 30 detects an event from probe data acquired by means of the sensors 50 (step S51), the vehicle-installed terminal apparatus 30 transmits the "uplink notification" to the center apparatus 10 (step S52). Because a feature score vector or the unconditional uplink request is then transmitted from the center apparatus 10, the vehicle-installed terminal apparatus 30 judges whether a feature score vector has been transmitted (step S53).

If it is judged that a feature score vector has not been transmitted ("No" in step S53), that is, if the unconditional uplink request is made, then the vehicle-installed terminal apparatus 30 uplinks the probe data and the event label to the center apparatus 10 (step S54). On the other hand, if a feature score vector has been transmitted ("Yes" in step S53), then the corresponding probe data is partitioned based on the pre-unified event section information included in the feature score vector as was shown in FIG. 5 (step S55).

The vehicle-installed terminal apparatus 30 then performs orthogonal component decomposition by the received feature score vector on the portion of the probe data, among the partitioned probe data, that is included in the preexisting section (pre-unified event section) (step S56; see FIG. 8), and judges whether or not the norm of the orthogonal component is no less than the predetermined threshold value (step S57). If it is judged that the norm of the orthogonal component is no less than the predetermined threshold value ("Yes" in step S57), then the vehicle-installed terminal apparatus 30 uplinks the probe data of the new section, the orthogonal component of the preexisting section, and the event label to the center apparatus 10 (step S58). Meanwhile, if the norm of the orthogonal component does not reach the predetermined threshold value ("No" in step S57), then the vehicle-installed terminal apparatus 30 uplinks the probe data and the event label of the new section to the center apparatus 10 (step S59).

The vehicle-installed terminal apparatus 30 then receives the event data distributed from the center apparatus 10 (step S60) and displays the received event data on the display device (step S61). The display method is as shown in FIG. 9.

According to the above-described embodiments, the vehicle-installed terminal apparatus 30 does not transmit the entire probe data to the center apparatus 10 upon detection of an event but transmits the probe data or an orthogonal component with respect to a feature score vector (1) when a feature score vector is not transmitted from the center apparatus 10, (2) when there exists a component that is orthogonal to the feature score vector transmitted from the center apparatus 10, or (3) when the vehicle-installed terminal apparatus 30 is outside the section of the feature score vector transmitted from the center apparatus 10. That is, when the probe data has the same features as those of the probe data that the center apparatus 10 has, the vehicle-installed terminal apparatus 30 does not transmit the probe data to the center apparatus 10. Thus, even when the same event is detected by the vehicle-installed terminal apparatuses 30 of a plurality of vehicles, if the probe data are similar, the probe data are not redundantly transmitted to the center apparatus 10. The amount of probe data transmitted from the vehicle-installed terminal apparatuses 30 to the center apparatus 10 can thus be reduced and consequently, the processing load of the center apparatus 10 is also lightened.

Also, according to the embodiments, similar feature data are extracted from a plurality of probe data by the feature space projection process by principal component analysis, and events are assigned to road sections in which the extracted feature data are present. Because this principal component analysis only extracts mutually correlated feature data from a large number of data, training data are not required as in adaptive resonance theory and results that do not depend on the types of probe data, that is on the types and individual differences of the sensors 50 can be obtained. Thus, with the present embodiment, even if probe data are successively input into the center apparatus 10, the center apparatus 10 can extract feature data from the probe data, assign events to the feature data, and distribute the assigned events to the vehicle-installed terminal apparatuses in real time and in a continuous manner.

Various modifications are possible for the embodiment described above. For example, the center apparatus 10 may be arranged to distribute a feature score vector on a regular basis so that the transmission of the "uplink notification" to the center apparatus 10 upon detection of an event by each vehicle-installed terminal apparatus 30 can be omitted. The same effects as the present embodiment can be obtained in this case as well.

Also, the vehicle-installed terminal apparatus 30 in the embodiment described above may be realized as a portion of a car navigation device with a communication function. In this case, the vehicle-installed terminal apparatus 30 can readily display the event data, distributed from the center apparatus 10 on a map. The vehicle-installed terminal apparatus 30 is thus not required to be restricted to displaying the distributed event data when the corresponding vehicle is about to enter the road link in which the event is occurring and can display the event, that is, the traffic information of the present time on a map at any time.

The above description of the embodiment was premised on the use of data (sensor data) of vehicle-installed sensors by a vehicle-installed terminal (referred to hereinafter as a "incorporated probe terminal") connected to an intra-vehicle network. Meanwhile, a portable navigation terminal, such as a cellular phone with GPS or PND (personal navigation device), which a driver brings into a vehicle from outside the vehicle and installs in a vehicle, can uplink position data of the built-in GPS or acceleration data, obtained by an acceleration sensor or gyroscope, to a traffic information center as probe data. However, the sensor data of vehicle-installed sensors, such as a vehicle-installed radar, infrared camera, slip sensor, etc., cannot be acquired directly from a vehicle and uplinked to a traffic information center. However, if the probe data from portable navigation terminals, which are in an increasing trend, can be used to perform event detection such as obstacle detection, freeze detection, etc., the area coverage of the event information can be improved.

To use probe data of a portable navigation terminal for event detection, position data and acceleration data must be associated with event occurrence. In a modification of the above embodiments, the probe data of an incorporated probe terminal is used as an association index. A specific method for this purpose will now be described.

Figure 12:
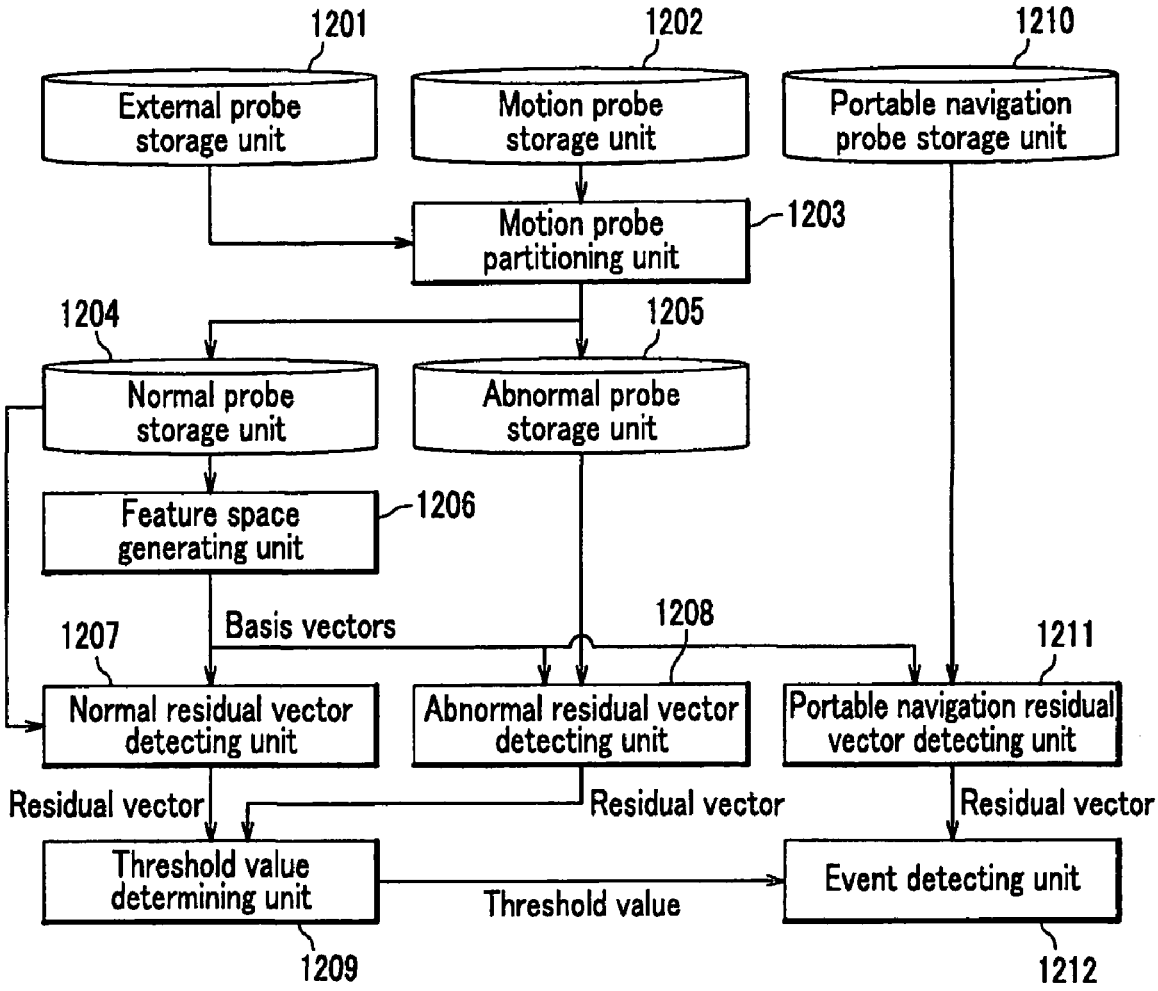
FIG. 12 is a diagram of an example of an arrangement of functional blocks of a system for performing event judgment based on probe data from a portable navigation terminal according to a modified embodiment of the present invention.

FIG. 12 is a block diagram of a system arrangement of the present example. An external probe storage unit 1201 is a storage device that records probe data concerning the external environment (referred to hereinafter as "external probe data"), such as vehicle-installed radar data, infrared sensor data, slip sensor data, event detection results, etc., that are uplinked from an incorporated probe terminal. A motion probe storage unit 1202 is a storage device that records probe data concerning vehicle motion (referred to hereinafter as "motion probe data"), such as GPS data, acceleration sensor data, gyroscope data, etc. The probe data of the external probe storage unit 1201 and the motion probe storage unit 1202 are associated by an ID (referred to hereinafter as "trip ID") that uniquely indicates each trip. A trip refers to a single trip by a single vehicle, and even when the date and time are the same, a trip becomes a separate trip if the vehicle differs, and even for the same vehicle, a trip becomes a separate trip if the date and time differ.

A motion probe partitioning unit 1203 divides the motion probe data, recorded in the motion probe storage unit 1202, into normal state (a state in which an event such as obstacle, freezing, etc., is not detected) motion probe data and abnormal state (a state in which an obstruction event such as obstacle, freezing, etc., is detected) motion probe data based on the external probe data, recorded in the external probe storage unit 1201, and by the same process as that of the feature space projection processing unit 14, the change point detecting unit 15, and the event section partitioning unit 16 described above, and respectively records these data into a normal probe storage unit 1204 and an abnormal probe storage unit 1205.

A feature space generating units 1206 performs principal component analysis on the motion probe data recorded in the normal probe storage unit 1204 to determine a base vector and generates a feature space that expresses the motion of the vehicle in the normal state. A normal residual vector detecting unit 1207 projects the same motion probe data, recorded in the normal probe storage unit 1204, onto the generated feature space and determines a residual vector with respect to the projective data. Meanwhile, an abnormal residual vector detecting unit projects the motion probe data recorded in the abnormal probe storage unit 1205 onto the same feature space and determines a residual vector with respect to the projective data. By comparing the residual vectors detected by the normal residual vector detecting unit 1207 and the abnormal residual vector detecting unit 1209, a threshold value determining unit 1209 determines a threshold value for making a normal/abnormal judgment from motion probe data.

Figure 13:
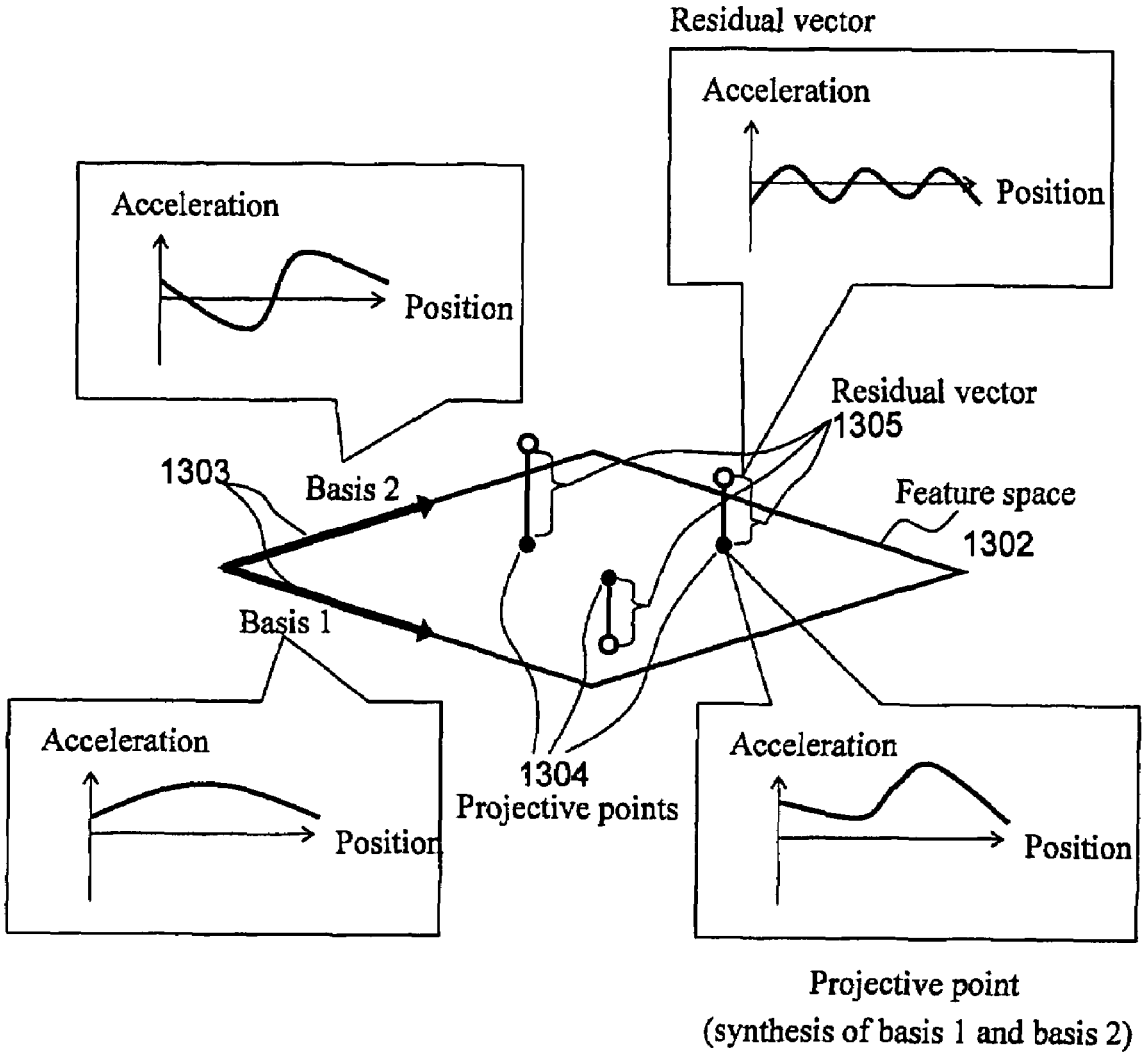
FIG. 13 is a schematic view of concepts of a normal residual vector detecting unit according to a modified embodiment of the present invention.
Figure 14:
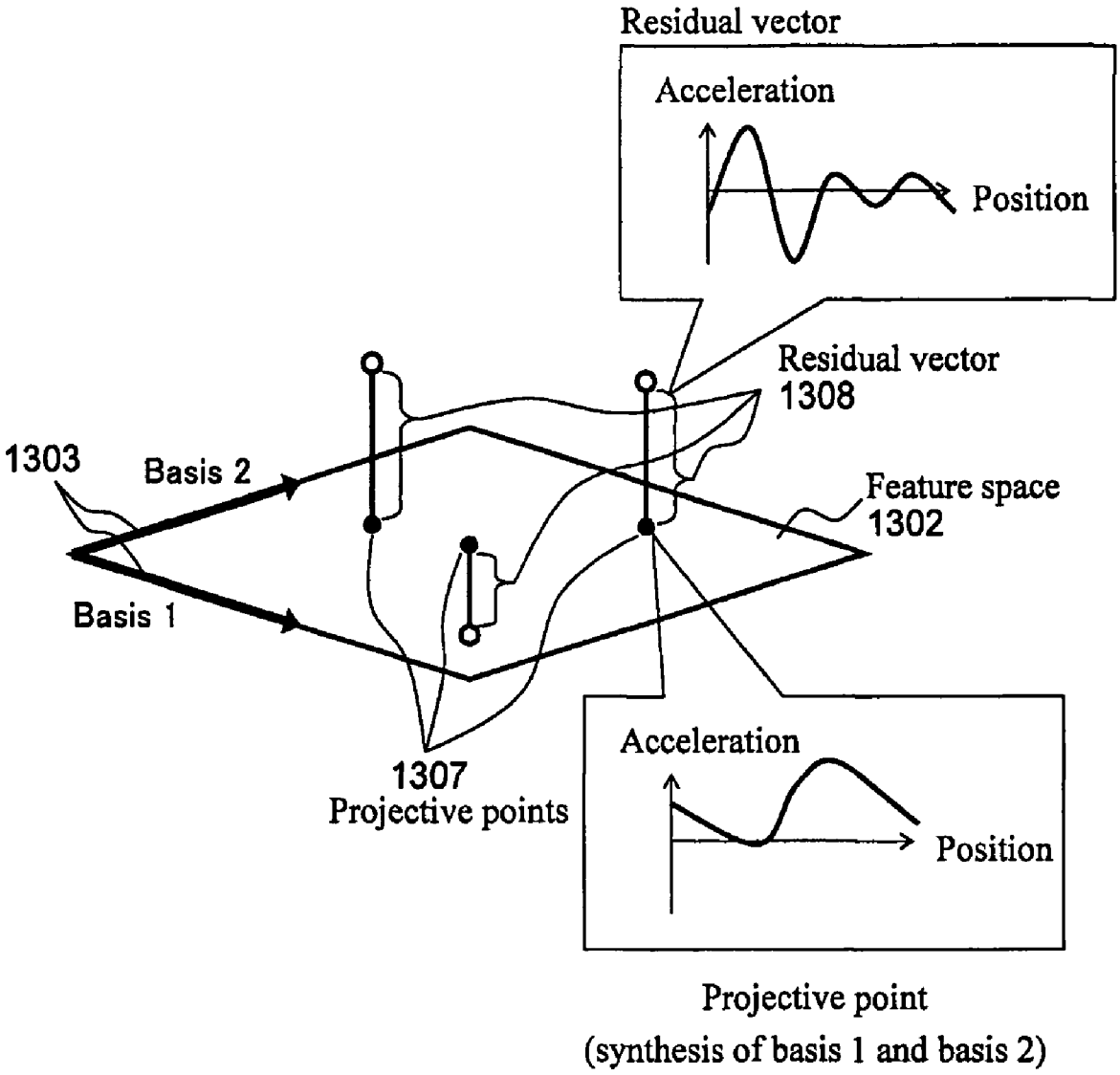
FIG. 14 is a schematic view of concepts of an abnormal residual vector detecting unit according to a modified embodiment of the present invention.

FIGS. 13 and 14 are schematic views illustrating a series of processes, from the calculation of a base vector by the feature space generating unit 1206 to the calculation of a residual vector by the normal residual vector detecting unit 1207 and the abnormal residual vector detecting unit 1208 and the calculation of the threshold value by the threshold value determining unit 1209, for lateral direction (direction perpendicular to a direction of progress along a road) acceleration data, among the motion probe data.

A normal acceleration history 1301 is a set of array data, with which changes of acceleration with respect to a position on a road section to be subject to processing are described according to each trip based on the motion probe data recorded in the normal probe storage unit 1204. In the normal acceleration history 1301, each row expresses a single trip, and each column expresses the same position on the road section to be subject to processing. Here, the road section to be subject to be processing shall be deemed to be a road section that has been partitioned with an interval between major intersections or an interval between bottleneck points as a single unit. In the feature space generating unit 1206, by performing principal component analysis on the normal acceleration history 1301, a base (base vector) that generates a feature space that can approximate the normal acceleration history 1301 is obtained. The base vector that spans this feature space corresponds to an acceleration component in common to the respective trips on the road section subject to processing.

When in the normal residual vector detecting unit 1207, the normal acceleration history 1301 is projected, according to each trip, onto the feature space based on a base vector determined by the feature space generating unit 1206, a residual vector arises for each trip. In FIG. 13, when the normal acceleration history is projected, according to each trip, onto a feature space 1302 spanned by base vectors 1303, a residual vector 1305 arises for a normal acceleration history projective point 1304 of each trip. This residual vector is an acceleration component unique to a trip that cannot be expressed by the base vectors used to generate the feature space.

For example, on a curving road, a lateral direction acceleration change that is in accordance with the curvature of the road occurs and, though differences in magnitude occur according to the travel speed, a correlation such that when the acceleration increases at a certain location, the acceleration decreases at another corresponding location is indicated in common for many vehicles that travel the road section to be subject to processing. This is the acceleration component of the base vector. The base vector is not restricted to one and a plurality exists in accordance with the number of patterns of acceleration change that are in common to vehicles that travel the road section to be processed. With the example of FIG. 13, the feature space is generated by the two base vectors of a base 1, corresponding to the lateral direction acceleration change pattern, and a base 2, corresponding to the acceleration change such that when the acceleration increases at a certain location, the acceleration decreases at another corresponding location. Each of the acceleration histories of the respective trips that are expressed by white circles is a synthetic value of a common acceleration component expressed by the base vectors and an acceleration component unique to each trip, and by projection onto the feature space 1302, spanned by the base vectors 1303, each acceleration history is decomposed into a projective point 1304 and a residual vector 1305. That is, the residual vector 1305 becomes greater the greater the acceleration component unique to each trip.

As shown in FIG. 14, in the abnormal residual vector detecting unit 1208, an abnormal acceleration history 1306, obtained from the abnormal state motion probe data recorded in the abnormal probe storage unit 1205, is projected, according to each trip, onto the feature space 1302 to determine residual vectors 1308 with respect to projective points 1307 in the same manner as in the case of projection of the normal acceleration history 1301. As with the normal acceleration history 1301, the abnormal acceleration history 1306 is a set of array data, with which the changes of acceleration with respect to positions on the road section to be subject to processing, are described according to each trip and includes an acceleration component that accompanies an evasion motion that in turn accompanies an event detection, such as a sudden steering wheel operation for obstacle evasion. Such an acceleration component does not appear in common to each trip and is an acceleration component unique to each trip that cannot be expressed by the base vectors 1301 obtained by principal component analysis of the normal acceleration history 1301. Because this is an acceleration component that accompanies an operation in an abnormal state, the residual vectors 1308 of the respective trips of the abnormal acceleration history tend to be greater than the residual vectors 1305 of the normal acceleration history. Thus, by determining a threshold value based on a distribution of the two types of residual vectors, judgment between a normal state and an abnormal state, that is, judgment of event occurrence by the magnitude of the residual vector on the feature space is enabled.

Figure 15:
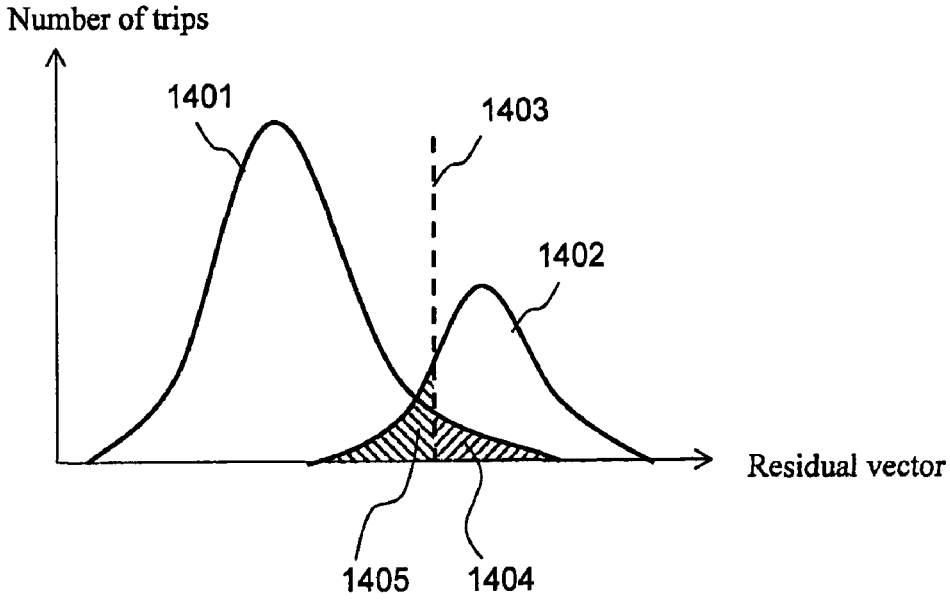
FIG. 15 is a diagram for describing residual vector distributions and a threshold value according to a modified embodiment of the present invention.

FIG. 15 is a schematic histogram of a distribution 1401 of the residual vectors 1305 of the normal acceleration history and a distribution 1402 of the residual vectors 1308 of the abnormal acceleration history. The abscissa axis indicates the magnitude of the residual vector for each trip and the ordinate axis indicates the number of trips. Here, when a threshold value 1403 is determined, an error rate E can be computed by the following equation from the ratio of the number of trips Tn' of residual vectors 1404 of the normal acceleration history that exceed the threshold value with respect to the total number of trips Tn of the normal state:

$$E=Tn'/Tn \qquad \text{Equation 1}$$

This error rate E is the probability at which, even when an event is not occurring, it is judged that an event is occurring due to the residual vector of a trip exceeding the threshold value.

Likewise, from the ratio of the number of trips Th' of residual vectors 1405 of the abnormal acceleration history that fall below the threshold value 1403 and the total number of trips Th of the abnormal acceleration history, a miss rate M can be computed by the following equation:

$$E=Th'/Th \qquad \text{Equation 2}$$

This miss rate M is the probability at which, even though an event is occurring, it is judged that an event is not occurring due to the residual vector of a trip falling below the threshold value.

It can be said that in event occurrence judgment, the lower both the error rate E and the miss rate M, the higher the judgment accuracy. However, as can be seen from FIG. 15, the error rate E increases when the threshold value 1403 is made small, and the miss rate increases when the threshold value 1403 is made large. In the threshold value determining unit 1209, either a ratio of the error rate E and the miss rate M is set or an upper limit is set for either the error rate E or the miss rate M, and the threshold value 1403 is determined from the normal acceleration history residual vector distribution 1401 and the abnormal acceleration history residual vector distribution 1402 so as to satisfy the ratio of the error rate E and the miss rate M or the upper limit set for either the error rate E or the miss rate M.

The series of processes, from the process of the feature space generating unit 1206 to the calculation of residual vectors by the normal residual vector detecting unit 1207 and the abnormal residual vector detecting unit 1207 and the calculation of the threshold value by the threshold value determining unit 1209 that were described using FIGS. 13, 14, and 15 constitute a preparation process for performing event occurrence judgment by using probe data uplinked from the incorporated probe terminal, associating external probe data and motion probe data, and performing feature space projection of the motion probe data. This preparation process is performed, for example, as an offline process using probe data including both normal state and abnormal state trips that have been uplinked from the incorporated probe terminal in the past month. This online process is performed repeatedly at a specific cycle.

An online process using the feature space 1302, generated by the base vectors generated by the feature space generating unit 1206, and the threshold value 1403, determined by the threshold value determining unit 1209, to judge the occurrence of an event from probe data from a portable navigation terminal will now be described.

Figure 16:
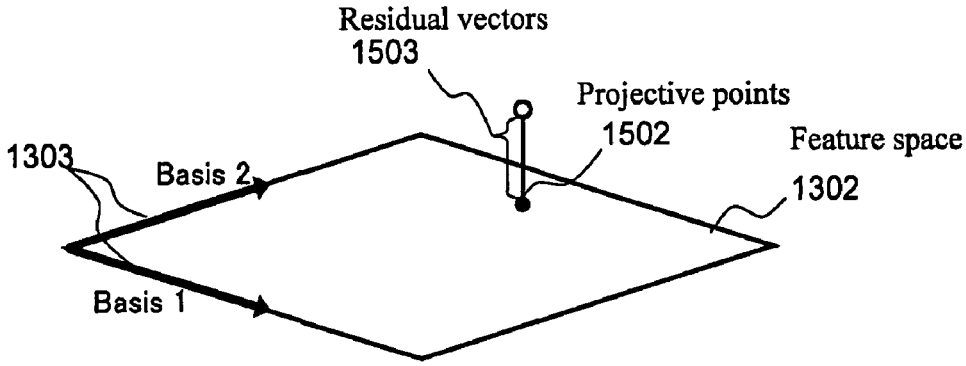
FIG. 16 is a diagram of concepts of a navigation residual vector detecting unit according to a modified embodiment of the present invention.

A portable navigation probe storage unit 1210 is a device that temporarily records and stores probe data uplinked from a portable navigation terminal. Because due to restrictions of the portable navigation terminal, external probe data are not collected, the probe data uplinked from the portable navigation terminal are restricted to motion probe data. The storage period of the probe data recorded in the portable navigation probe storage unit 1210 shall be deemed, for example, to be the same as the processing cycle of the online process. As shown in FIG. 16, at a portable navigation residual vector detecting unit 1211, an acceleration history 1501, based on the probe data recorded in the portable navigation probe storage unit 1210, is projected onto the feature space 1302 generated by the base vectors generated by the feature space generating unit 1206 to determine a projective point and a residual vector 1503. At the event detecting unit 1212, the residual vector 1503 and the threshold value 1403, determined by the threshold value determining unit 209, are compared and if the residual vector 1503 exceeds the threshold value 1403, it is judged that an event has occurred, and if not, it is judged that an event has not occurred.

If a plurality of probe data are uplinked from the portable navigation terminal at the same road section and within the processing cycle of the online process, the judgment results of the event detecting unit 1212 are tallied for the respective trips, and if the number of trips for which it is judged that an event has occurred is greater than the number of trips for which it is judged that an event has not occurred, it is judged that an event has occurred in the road section.

In the process described with FIGS. 13 to 16, an acceleration history in the vertical direction (direction of progress along a road) or a speed history, generated by differentiation of the position history, may also be used. For example, although for obstacle detection, because an acceleration in a lateral direction occurs due to an evasive operation, the use of the acceleration history in the lateral direction is suited, for freeze detection, because driving of suppressed acceleration and deceleration is performed on a frozen road, the use of the acceleration history in the vertical direction suited for analysis.

By the process described above, the probe data of incorporated probe terminals can be used as training data and the probe data of abundantly used portable navigation terminals can be used for event judgment.

It is contemplated that various modifications may be made to the exemplary embodiments of the invention without departing from the scope of the embodiments of the present invention as defined in the following claims.

What is claimed is:

1. A system for collecting and distributing traffic information, comprising:

a vehicle-installed apparatus installed in each vehicle and configured to transmit data which comprises sensor data output by a sensor provided in the vehicle; and a center apparatus configured to receive and manipulate the data transmitted by the vehicle-installed apparatus, wherein the vehicle-installed apparatus comprises:

an event detecting unit configured to detect an obstruction event on a road, from the sensor data; and a probe data transmitting unit configured to transmit probe data, wherein the probe data comprises an event label indicating a type of the obstruction event and position information on a position at which the obstruction event detected has occurred, in addition to the sensor data, and wherein the center apparatus comprises:

a change point detecting unit configured to detect an event change point at which the sensor data in the probe data collected from a plurality of vehicles have changed in a correlated manner;

an event section partitioning unit configured to partition a road into road sections at the event change point;

an event assigning unit configured to assign an event label contained in the probe data to a corresponding road section;

an event data storage unit configured to store event data composed of pairs of road sections and event labels assigned thereto; and an event data distributing unit configured to distribute the event data to the vehicle-installed apparatus.

2. The system according to claim 1, wherein the center apparatus further comprises a feature space projection processing unit configured to project the probe data collected from the plurality of vehicles, onto a feature space by principal component analysis, and wherein the change point detecting unit comprises means for detecting the event change point based on a change of a feature space vector of the probe data projected onto the feature space.

3. The system according to claim 1, wherein the event assigning unit comprises means for selecting one event label to be assigned to a road section among a plurality of event labels, wherein the selected one event label is of obstruction events that have been detected by a majority of vehicles in the road section.

4. The system according to claim 1, wherein when the center apparatus repeatedly executes the process by the change point detecting unit, the process by the event section partitioning unit, and the process by the event assigning unit, the event data distributing unit distributes event data newly recorded in the event data storage unit, with a new flag affixed to the event data.

5. The system according to claim 1, wherein the vehicle-installed apparatus further comprises an event data display unit for displaying an icon and character information in accordance with the event label; and the event data display unit is configured to display the event data distributed from the center apparatus, and an obstruction event detected by means of the event detecting unit in the vehicle in which the vehicle-installed apparatus is installed, in a distinguishing manner.

6. The system according to claim 1, wherein the vehicle-installed apparatus further comprises an event data display unit for displaying an icon and character information in accordance with the event label;

when the center apparatus repeatedly executes the process by the change point detecting unit, the process by the event section partitioning unit, and the process by the event assigning unit, the event data distributing unit distributes event data newly recorded in the event data storage unit, with a new flag affixed to the event data; and the event data display unit is configured to display event data to which the new flag is affixed, and event data to which no new flag is affixed, in a distinguishing manner.

7. A method for collecting and distributing traffic information, which method is implemented in a system comprising a vehicle-installed apparatus installed in a vehicle and configured to transmit a sensor data output by a sensor provided in the vehicle, and a center apparatus configured to receive and process the sensor data, the method comprising:

detecting, in the vehicle-installed apparatus, an obstruction event on a road from the sensor data; and transmitting probe data from the vehicle-installed apparatus, wherein the probe data comprises an event label indicating a type of the obstruction event and position information on a position at which the obstruction event detected has occurred, in addition to the sensor data; and detecting, in the center apparatus, an event change point at which the sensor data in the probe data collected from a plurality of vehicles have changed in a correlated manner;

partitioning a road into road sections at the event change point;

assigning an event label contained in the probe data to a corresponding road section; and distributing event data composed of pairs of road sections and event labels assigned thereto, from the center apparatus to the vehicle-installed apparatus.

8. The method according to claim 7, wherein detecting the event change point comprises detecting the event change point based on a change of a feature space vector resulting from projection of the probe data, collected from the plurality of vehicles, onto the feature space by principal component analysis.

* * * * *